US005869217A

United States Patent [19]

Aono

[11] Patent Number: 5,869,217

[45] Date of Patent: Feb. 9, 1999

[54] SILVER HALIDE PHOTOGRAPHIC MATERIAL AND PHOTOGRAPHIC ELEMENT

[75] Inventor: Toshiaki Aono, Kanagawa, Japan

[73] Assignee: Fuji Photo Film Co., Ltd., Kanagawa, Japan

[21] Appl. No.: 899,774

[22] Filed: Jul. 24, 1997

[30] Foreign Application Priority Data

Jul. 24, 1996 [JP] Japan ..... 8-195115

[51] Int. Cl.[6] ..... G03C 8/52; G03C 8/10; G03C 1/04; G03C 1/76

[52] U.S. Cl. ..... 430/213; 430/206; 430/203; 430/215; 430/220; 430/217; 430/230; 430/231; 430/232; 430/503; 430/404; 430/523; 430/527; 430/539; 430/546; 430/608; 430/631; 430/950; 430/961; 430/227

[58] Field of Search ..... 430/231, 232, 430/230, 217, 220, 215, 523, 539, 608, 527, 950, 961, 631, 503, 546, 203, 213, 206, 404, 227

[56] References Cited

U.S. PATENT DOCUMENTS

| | | | |
|---|---|---|---|
| 3,345,168 | 10/1967 | Wagner et al. | 430/232 |
| 4,173,480 | 11/1979 | Woodward | 430/536 |
| 5,478,709 | 12/1995 | Vandenabeele | 430/527 |
| 5,618,650 | 4/1997 | De Keyzer et al. | 430/232 |

*Primary Examiner*—Richard L. Schilling
*Attorney, Agent, or Firm*—Sughrue, Mion, Zinn, Macpeak & Seas, PLLC

[57] ABSTRACT

A silver halide photographic material which has a layer containing a swellable inorganic stratifying compound.

10 Claims, 1 Drawing Sheet

SILVER HALIDE PHOTOGRAPHIC MATERIAL AND PHOTOGRAPHIC ELEMENT

FIELD OF THE INVENTION

The present invention relates to a photographic element and, in particular, a photographic element in which the diffusion of a photographically useful compound is controlled and/or a photographic element in which the storage stability of a photographically useful compound is improved.

BACKGROUND OF THE INVENTION

In a silver halide photographic field, a photographic element such as a light-sensitive element, an image-receiving element, etc., are constructed by introducing various photographically useful compounds into a hydrophilic colloid layer to express various photographic functions.

As a method of introducing photographically useful compounds into a hydrophilic colloid layer which is a photographic element, photographically useful compounds are dissolved in water and directly added to a coating solution when they are soluble in water. On the other hand, when they are insoluble in water, any of the following methods has been adopted: (1) they are dissolved in an organic solvent which is miscible with water and directly added to a coating solution, (2) they are dissolved in an organic solvent which is immiscible with water, emulsified and dispersed in a protective colloid solution and added to a coating solution (an emulsifying dispersion method), (3) they are finely dispersed in water or a protective colloid solution in a solid state by a mill, etc., and added to a coating solution as a solid dispersion (a solid dispersion method), or (4) they are added to a coating solution as a latex or added by being impregnated in a latex.

The photographically useful compounds which are added to each photographic element layer by various methods as described above are, in general, used by being fixed in that layer. However, they diffuse between layers during storage before and after processing and various problems arise, for example:

(1) Color mixing occurs by the diffusion of the coloring material added to and fixed in an emulsion layer or a coloring material layer as an emulsified product to the adjacent layers which differently colors. A countermeasure is usually taken to this problem, for example, the oil/binder ratio of the layer to which a coloring material is added is made small, the thickness of the interlayer is made thick, or a coloring material or the oil for dissolving the coloring material is highly polymerized. However, any of these countermeasures is accompanied by bad effects such that coloring capability is deteriorated, the diffusion of a dye is inhibited in the case of a diffusion transfer system, or the curling property is deteriorated due to the increase of a film thickness.

(2) An additive which affects photographic properties, such as a development inhibitor, a development accelerator, a reducing agent or a dye, diffuses to adjacent layers depending on the storing conditions and often causes the deterioration of photographic properties. To prevent this problem, countermeasures such as the increase of the molecular weight of the additive, the introduction of a hydrophobic group, the increase of the thickness of the interlayer, and the like are taken. However, these countermeasures are accompanied by bad effects such that the effect of the additive is reduced, and the curling property is deteriorated due to the increase of a film thickness.

(3) When a photographic material is stored, in particular, under a high humidity condition, the additive diffuses all over the layer and is precipitated on the surface. As a result, chalking fault occurs. In general, binders are selected and the addition amounts thereof are increased for solving this problem. However, such countermeasures are not sufficient to solve this problem, and a bad effect such that the curling property is deteriorated due to the increase of a film thickness occurs.

Further, even if the above problems do not occur by the diffusion between layers of the compounds added by themselves, the following problems arise by the diffusion of oxygen, water vapor, nitrogen oxides, sulfur oxides, etc., from the air into layers.

(4) The compounds contained are oxidized by oxygen and deteriorated or photodiscoloration is accelerated by the irradiation of light in the presence of oxygen. To prevent such problems, an antioxidant and an ultraviolet absorber are added, or a protective layer or an interlayer of a polymer having low permeability of oxygen are provided, but the effects are not always sufficient and also the curling property is deteriorated.

(5) The compounds added are deteriorated under a high humidity condition.

(6) A trace amount of nitrogen oxides or sulfur oxides in the air diffuses in a film and reacts with the compounds contained in the photographic element, as a result, problems such as coloration, discoloration, degeneration and the like arise.

SUMMARY OF THE INVENTION

Accordingly, an object of the present invention is to provide a method for solving various problems caused by the diffusion between layers of various additives and photographically useful compounds added to photographic elements or the diffusion of various gases in the air (oxygen, water vapor, carbon dioxide, nitrogen oxides, sulfur oxides, etc.) into photographic element layers, without changing the structures of additives themselves, also without changing the composition of the layer to which additives are added, or without deteriorating the curling property due to the increase of the film thickness of the interlayer.

The above object of the present invention was achieved by a silver halide photographic material or a photographic element of the following (1) to (6).

(1) A silver halide photographic material comprising a support having provided thereon at least one light-sensitive silver halide emulsion layer, wherein at least one layer of said silver halide photographic material comprises a swellable inorganic stratifying compound.

(2) A silver halide photographic material as described in (1) above, which further comprises at least one light-insensitive layer and wherein said swellable inorganic stratifying compound is contained in at least one light-insensitive layer.

(3) A photographic element which comprises a support having provided thereon a light-sensitive element comprising at least one light-sensitive silver halide emulsion layer and an image-receiving element receiving a silver image or a dye image formed in said light-sensitive element, wherein at least one layer of said photographic element comprises a swellable inorganic stratifying compound.

(4) The photographic element as described in (3) above, wherein said swellable inorganic stratifying compound is contained in at least one light-insensitive layer.

(5) A photographic element which comprises a support having provided thereon a light-sensitive element comprising at least one light-sensitive silver halide emulsion layer and a processing element which is capable of being closely contacted with said light-sensitive element during development to have a function to supply components necessary for development to said light-sensitive element, a function to remove components which are unnecessary after development from said light-sensitive element or both of said functions, wherein at least one layer of said photographic element comprises a swellable inorganic stratifying compound.

(6) The photographic element as described in (5) above, wherein contains said swellable inorganic stratifying compound is contained in at least one light-insensitive layer.

DETAILED DESCRIPTION OF THE INVENTION

Figure 1:
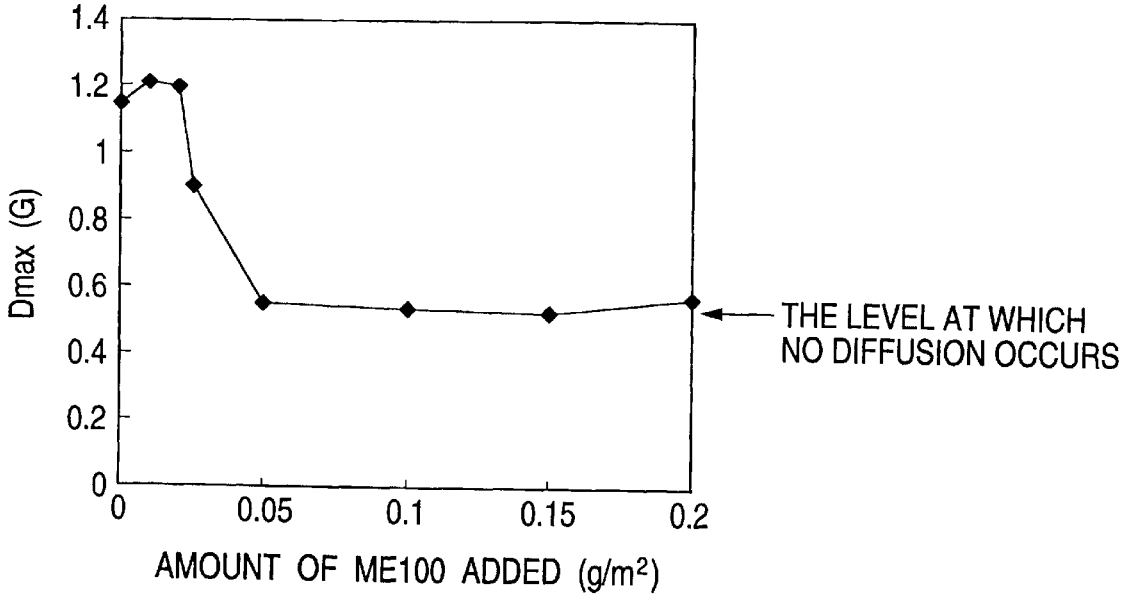
FIG. 1 is a graph showing the results in Example 1, wherein the axis of ordinate indicates optical density and the axis of abscissa indicates the addition amount of the compound according to the present invention to the photographic material.

The present invention will be described in detail below.

Examples of swellable inorganic stratifying compounds for use in the present invention include swellable clay minerals, e.g., bentonite, hectorite and montmorillonite, swellable synthetic mica, swellable synthetic smectite, etc. These swellable inorganic stratifying compounds have a laminated structure comprising layers of a unit crystal lattice having a thickness of from 10 to 15 Å and the metal atom substitution in the lattice is extremely large compared with other clay minerals. As a result, the lattice layer becomes short of positive electric charge and cations such as $Na^+$, $Ca^{2+}$, $Mg^{2+}$, etc., are adsorbed between layers to compensate for this shortage. These cations intercalating between layers are called exchangeable cations and exchanged for various cations. In particular, when cations adsorbed between layers are $Li^+$and $Na^+$, ion radius thereof is small and, therefore, the bond between stratifying crystal lattices is weak. Accordingly, lattice layers are swollen by water to a great extent. When the layers are sheared at that state, crystals are easily cleaved and stable sol is formed in water. Bentonite and swellable synthetic mica have such a tendency markedly and are preferred for the object of the present invention. In particular, swellable synthetic mica is preferably used.

Examples of swellable synthetic mica for use in the present invention include:

Na tetrasic mica, $NaMg_{2.5}(Si_4O_{10})F_2$,

Na or Li teniorite, $(NaLi)Mg_2Li(Si_4O_{10})F_2$,

Na or Li hectorite $(NaLi)_1/3Mg_2/3Li_{1/3}(Si_4O_{10})F_2$.

The swellable synthetic mica preferably used in the present invention has a thickness of from 1 to 50 nm and a plane face size of from 1 to 20 $\mu$m. For controlling diffusion, the thickness is preferably as thin as possible, and the plane face size is preferably as large as possible within the range not deteriorating the smoothness and the transparency of the face coated. Accordingly, the aspect ratio is 100 or more, more preferably 200 or more, and particularly preferably 500 or more.

The addition amount of the swellable inorganic stratifying compound for use in the present invention is, when diffusion is controlled by using it in an interlayer or a protective layer, from 50 to 500 mg/m$^2$, preferably from 100 to 300 mg/m$^2$. When the compound is used to improve the film quality, the amount may be selected arbitrarily in the range of from 5 to 5,000 mg/m$^2$ according to purposes.

As the surface of the swellable inorganic stratifying compound for use in the present invention is charged with minus charge, it is not preferred to contain polymers having a cation site and cationic surfactants in the same layer with the swellable inorganic stratifying compound.

Gelatin is preferably used as the binder for the layer which contains the swellable inorganic stratifying compound for use in the present invention, but other hydrophilic colloids can also be used. Examples thereof include proteins such as gelatin derivatives, graft polymers of gelatin and other high polymers, albumin and casein; sugar derivatives such as cellulose derivatives (e.g., hydroxyethyl cellulose, carboxymethyl cellulose, and cellulose sulfate, sodium alginate), and starch derivatives; and various kinds of synthetic hydrophilic high polymers of homopolymers or copolymers such as polyvinyl alcohol, partially acetalated polyvinyl alcohol, poly-N-vinylpyrrolidone, polyacrylic acid, polymethacrylic acid, and polyacrylamide.

Acid-processed gelatin can be used as well as lime-processed gelatin, and hydrolyzed product of gelatin and enzyme degraded product of gelatin can also be used. As gelatin derivatives, products obtained by reacting gelatin with various compounds, e.g., acid halide, acid anhydride, isocyanates, bromoacetic acid, alkane sultones, vinyl sulfonamides, maleinimide compounds, polyalkylene oxides, and epoxy compounds can be used.

As the refractive index of the swellable synthetic mica for use in the present invention is about 1.53, polymers having the same degrees of refractive indices are preferably used as binders in combination. As the refractive index of gelatin is from 1.53 to 1.54, it is particularly preferably used as a dispersion polymer of swellable synthetic mica or a binder.

The amount of the binder to be used in the layer to which the swellable inorganic stratifying compound for use in the present invention is added is from 1 to 2,000 weight parts, preferably from 10 to 1,000 weight parts, and particularly preferably from 25 to 500 weight parts, per 100 weight parts of the swellable inorganic stratifying compound.

The method of dispersing the swellable inorganic stratifying compound for use in the present invention is described below. From 5 to 10 weight parts of the swellable inorganic stratifying compound is added to 100 weight parts of water, taken to water sufficiently, swollen and dispersed using a disperser. Examples of dispersers for use in the present invention include various kinds of mills which disperse compounds mechanically by directly applying power, high speed agitating dispersers having high shearing force, and dispersers applying superhigh ultrasonic energy, specifically a ball mill, a sand grinder mill, a visco mill, a colloid mill, a homogenizer, a dissolver, a Polytron, a homomixer, a homoblender, a Keddy mill, a jet agitator, a capillary emulsifying apparatus, a liquid siren, an electromagnetic skewing ultrasonic wave generator, and an emulsifying apparatus equipped with a Paulman whistle.

The above-dispersed dispersion having from 5 to 10 wt % has high viscosity or is in a gel state and has extremely good storage stability. When this dispersion is added to a coating solution, it is diluted with water, sufficiently stirred, then added.

As the surface of the swellable inorganic stratifying compound for use in the present invention is charged with minus charge, adsorption of a cationic surfactant onto the surface makes the surface hydrophobic. When such a swellable inorganic stratifying compound-having hydrophobic surface is used, the compound is dispersed after being swollen with a solvent sufficiently miscible with the hydrophobic part of the cationic surfactant adsorbed onto the surface, then a binder solution is added to the compound to thereby prepare a coating solution.

The layer to which the swellable inorganic stratifying compound for use in the present invention is incorporated is not particularly limited as long as it is at least one photographic element, e.g., a surface protective layer, an emulsion layer, an interlayer, an undercoat layer, a backing layer, or other auxiliary layers, but is preferably a light-insensitive layer, in particular, a surface protective layer or an interlayer.

Examples of photographically useful compounds which can be used in the present invention include a dye image-forming coupler, a dye image donative redox compound, an antistaining agent, an antifoggant, an ultraviolet absorber, a discoloration inhibitor, a nucleating agent, a physical development speck, a silver halide solvent, a bleaching accelerator, a dye for filter and a precursor thereof, a dye, a pigment, a sensitizer, a hardening agent, a brightening agent, a desensitizer, a developer, an antistatic agent, an antioxidant, a developer scavenger, a latex, a dye capturing agent (a mordant, etc.), a development accelerator, a development inhibitor, a base or a base precursor, a thermal solvent, a toning adjustor, an oil for dispersion used as a medium for dispersing these compounds, a silver halide, and an organic silver salt. These compounds are described in *Research Disclosure* (*RD*), No. 17643, ibid., No. 18716 and ibid., No. 307105.

A part of these compounds are described below.

a) Dye Image-Forming Coupler

A compound which forms a colored or colorless dye upon coupling with the oxidation product of an aromatic primary amine development agent is called a coupler. Yellow, magenta, cyan and black couplers are useful as couplers.

Oil-protect-type acylacetamide based couplers are representative as yellow couplers which can be used in the present invention. Specific examples thereof are disclosed in U.S. Pat. Nos. 2,407,210, 2,875,057 and 3,265,506. As 2-equivalent yellow couplers, oxygen atom-releasing yellow couplers disclosed in U.S. Pat. Nos. 3,408,194, 3,447,928, 3,933,501 and 4,022,620, and nitrogen atom-releasing yellow couplers disclosed in JP-B-58-10739 (the term "JP-B" as used herein means an "examined Japanese patent publication"), U.S. Pat. Nos. 4,401,752, 4,326,024, *RD*, No. 18053 (April, 1979), British Patent 1,425,020, published West German Patent Application (OLS) Nos. 2,219,917, 2,261,361, 2,329,587 and 2,433,812 can be cited as representative examples. α-Pivaloylacetanilide based couplers are excellent in fastness of colored dye, in particular, light fastness. On the other hand, high color density can be obtained from α-benzoylacetanilide based couplers.

Of these couplers, for example, those disclosed in U.S. Pat. Nos. 3,933,501, 4,022,620, 4,326,024, 4,401,752, 4,248,961, JP-B-58-10739, British Patents 1,425,020, 1,476,760, U.S. Pat. Nos. 3,973,968, 4,314,023, 4,511,649, and EP-A-249473 are preferred.

As magenta couplers which can be used in the present invention, oil-protect type indazolone based or cyanoacetol based (preferably 5-pyrazolone based and pyrazoloazole based, such as pyrazolotriazoles) couplers can be cited. From the viewpoint of the hue of colored dye and color density, couplers substituted with an arylamino group or an acylamino group at the 3-position of 5-pyrazolone couplers are preferred, and representative examples thereof are disclosed in U.S. Pat. Nos. 2,311,082, 2,343,703, 2,600,788, 2,908,573, 3,062,653, 3,152,896, 3,936,015, etc. As a releasing group of 2-equivalent 5-pyrazolone based couplers, nitrogen atom-releasing groups disclosed in U.S. Pat. No. 4,310,619 and arylthio groups disclosed in U.S. Pat. No. 4,351,897 are preferred. Further, high color density can be obtained by 5-pyrazolone based couplers having a ballast group disclosed in European Patent 73636.

As pyrazoloazole based couplers, pyrazolobenzimidazoles disclosed in U.S. Pat. No. 3,369,879, pyrazolo[5,1-c][1,2,4]triazoles disclosed in U.S. Pat. No. 3,725,067, and pyrazolopyrazoles described in *RD*, No. 24220 (June, 1984) can be cited. In view of less side absorption of yellow of colored dye and light fastness, imidazo[1,2-b]pyrazoles disclosed in European Patent 119741 and pyrazolo[1,5-b][1,2,4]triazole disclosed in European Patent 119860 are preferred.

Of the above, those disclosed in U.S. Pat. Nos. 4,310,619, 4,351,897, European Patent 73636, U.S. Pat. Nos. 3,061,432, 3,725,067, *RD*, No. 24220 (June, 1984), JP-A-60-33552 (the term "JP-A" as used herein means an "unexamined published Japanese patent application"), *RD*, No. 24230 (June, 1984), JP-A-60-43659, JP-A-61-72238, JP-A-60-35730, JP-A-55-118034, JP-A-60-185951, U.S. Pat. Nos. 4,500,630, 4,540,654, 4,556,630, and WO 88/04795 are particularly preferred.

Cyan couplers which can be used in the present invention include oil protect type naphthol based and phenol based couplers, such as naphthol based couplers disclosed in U.S. Pat. No. 2,474,293, and oxygen atom-releasing type 2-equivalent naphthol based couplers disclosed in U.S. Pat. Nos. 4,052,212, 4,146,396, 4,228,233 and 4,296,200 can be cited as preferred representative examples thereof. Further, specific examples of phenol based couplers are disclosed in U.S. Pat. Nos. 2,369,929, 2,801,171, 2,772,162, and 2,895,826. Cyan couplers fast to humidity and temperature are preferably used in the present invention. Representative examples thereof include phenol based cyan couplers having an alkyl group such as an ethyl group or more at the meta-position of the phenol nucleus disclosed in U.S. Pat. No. 3,772,002, phenol based cyan couplers substituted with a 2,5-diacylamino group disclosed in U.S. Pat. Nos. 2,772,162, 3,758,308, 4,126,396, 4,334,011, 4,327,173, West German Patent 3,329,729, and JP-A-59-166956, and phenol based cyan couplers having a phenylureido group at the 2-position and an acylamino group at the 5-position disclosed in U.S. Pat. Nos. 3,446,622, 4,333,999, 4,451,559 and 4,427,767.

Naphthol based couplers substituted with a sulfonamido group, an amido group or the like at the 5-position disclosed in JP-A-60-237448, JP-A-61-153640 and JP-A-61-14557 are particularly excellent in fastness of developed color images and preferred. In addition, pyrazoloazole based couplers disclosed in JP-A-64-553, JP-A-64-554, JP-A-64-555 and JP-A-64-556 and imidazole based couplers disclosed in U.S. Pat. No. 4,818,672 can also be used.

Of these, particularly preferred are those disclosed in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, 4,327,173, West German Patent 3,329,729, EP-A-121365, EP-A-249453, U.S. Pat. Nos. 3,446,622, 4,333,999, 4,775,616, 4,451,559, 4,427,767, 4,690,889, 4,254,212, 4,296,199, and JP-A-61-42658.

Representative examples of polymerized dye-forming couplers are disclosed in U.S. Pat. Nos. 3,451,820, 4,080,211, 4,367,282, 4,409,320, 4,576,910, British Patent 2,102,137 and EP-A-341188.

Couplers disclosed in U.S. Pat. No. 4,366,237, British Patent 2,125,570, European Patent 96570 and West German Patent 3,234,533 are preferred as couplers which can give the colored dyes having an appropriate diffusibility.

Colored couplers for correcting the unnecessary absorption of colored dyes are disclosed in *RD*, No. 17643, item VII-G, ibid., No. 307105, item VII-G, U.S. Pat. No. 4,163,670, JP-B-57-39413, U.S. Pat. Nos. 4,004,929, 4,138,258, and British Patent 1,146,368 and preferably used. Moreover, couplers correcting the unnecessary absorption of colored dyes by fluorescent dyes released upon coupling reaction disclosed in U.S. Pat. No. 4,774,181, and couplers having a dye precursor group capable of forming a dye upon reaction with a developing agent as a releasing group disclosed in U.S. Pat. No. 4,777,120 are also preferably used.

Compounds which release photographically useful residual groups upon coupling reaction are also preferably used in the present invention. Development inhibitor-releasing (DIR) couplers as disclosed in the patents described in the above *RD*, No. 17643, item VII-F, ibid., No. 307105, item VII-F, JP-A-57-151944, JP-A-57-154234, JP-A-60-184248, JP-A-63-37346, JP-A-63-37350, U.S. Pat. Nos. 4,248,962 and 4,782,012 are preferably used. Further, bleaching accelerator-releasing couplers described in *RD*, No. 11449, ibid., No. 24241, and JP-A-61-201247 are effective for shortening the processing time of the processing step having bleaching ability, in particular, they are very effective when added to a photographic material using tabular silver halide grains. As couplers which imagewise release a nucleating agent or a development accelerator at development time, those disclosed in British Patents 2,097,140, 2,131,188, JP-A-59-157638, and JP-A-59-170840 are preferred. Moreover, compounds which release a fogging agent, a development accelerator, a silver halide solvent, etc., by the oxidation reduction reaction with the oxidized product of a developing agent as disclosed in JP-A-60-107029, JP-A-60-252340, JP-A-1-44940, and JP-A-1-45687 are also preferred.

In addition, as the couplers which can be used in the photographic material of the present invention, there can be cited competitive couplers disclosed in U.S. Pat. No. 4,130,427, etc., multiequivalent couplers disclosed in U.S. Pat. Nos. 4,283,472, 4,338,393, 4,310,618, etc., DIR redox compound-releasing couplers, DIR coupler-releasing couplers, DIR coupler-releasing redox compounds, DIR redox-releasing redox compounds disclosed in JP-A-60-185950 and JP-A-62-24252, etc., couplers which release dyes showing restoration of color after elimination disclosed in EP-A-173302 and EP-A-313308, ligand-releasing couplers disclosed in U.S. Pat. No. 4,555,477, leuco dye-releasing-couplers disclosed in JP-A-63-75747, and fluorescent dye-releasing couplers disclosed in U.S. Pat. No. 4,774,181.

Two or more of the above couplers and the like can be used in combination in the same layer for satisfying the characteristics required of the photographic material.

b) Dye Image Donative Redox Compound

As other water-insoluble compounds which can be used in the present invention, a dye image donative redox compound for use in a color diffusion transfer photographic material (for wet development and heat development) can be cited. Specifically, the compound is represented by the following formula (LI):

$$(\text{Dye-Y})_n\text{—Z} \qquad \text{(LI)}$$

wherein Dye represents a dye group, a dye group or a dye precursor group temporally shortwaved; Y represents a single bond or a linking group; Z represents a group having the nature of making a difference in diffusibility of the compound represented by $(\text{Dye-Y})_n$—Z corresponding to or counter-corresponding to light-sensitive silver salt having imagewise a latent image, or the nature of releasing Dye and making a difference in diffusibility between the released Dye and $(\text{Dye-Y})_n$—Z, and n represents 1 or 2, and when n is 2, two (Dye-Y)'s may be the same or different.

Specific examples of the dye donative compounds represented by formula (LI) include the compounds in the following (i) to (v). Further, compounds in (i) to (iii) are compounds which form a diffusible dye image (a positive dye image) counter-corresponding to the development of silver halide, and compounds in (iv) and (v) are compounds which form a diffusible dye image (a negative dye image) corresponding to the development of silver halide.

(i) Dye developers of which dye component is linked with a hydroquinone based developer as disclosed in U.S. Pat. Nos. 3,134,764, 3,362,819, 3,597,200, 3,544,545 and 3,482,972. These dye developers are diffusible under an alkaline condition but become non-diffusible when reacted with silver halide.

(ii) Non-diffusible compounds which release a diffusible dye under an alkaline condition but lose such capabilities when reacted with silver halide, as disclosed in U.S. Pat. No. 4,503,137, can also be used. Examples thereof include compounds which release a diffusible dye by the intramolecular nucleophilic substitution reaction as disclosed in U.S. Pat. No. 3,980,479, and compounds which release a diffusible dye by the intramolecular rearrangement reaction of an isooxazolone ring as disclosed in U.S. Pat. No. 4,199,354.

(iii) Non-diffusible compounds which release a diffusible dye by reacting with the reducing agent remained without being oxidized by development can also be used as disclosed in U.S. Pat. No. 4,559,290, EP-A-220746, U.S. Pat. No. 4,783,396, and *JIII Journal of Technical Disclosure* (Kokai Giho) 87-6199.

Examples thereof include compounds which release a diffusible dye by the intramolecular nucleophilic substitution reaction after being reduced disclosed in U.S. Pat. Nos. 4,139,389, 4,139,379, JP-A-59-185333 and JP-A-57-84453, compounds which release a diffusible dye by the intramolecular electron transfer reaction after being reduced disclosed in U.S. Pat. Nos. 4,232,107, JP-A-59-101649, JP-A-61-88257, and *RD*, No. 24025 (1984), compounds which release a diffusible dye by the cleavage of a single bond after being reduced disclosed in West German published patent application 3,008,588A, JP-A-56-142530, U.S. Pat. Nos. 4,343,893 and 4,619,884, nitro compounds which release a diffusible dye after accepting an electron disclosed in U.S. Pat. No. 4,450,223, and compounds which release a diffusible dye after accepting an electron disclosed in U.S. Pat. No. 4,609,610.

Further, more preferred are compounds having an N—X bond (X represents an oxygen, sulfur or nitrogen atom) and an electron attractive group in one molecule disclosed in EP-A-220746, *JIII Journal of Technical Disclosure* (Kokai Giho) 87-6199, U.S. Pat. No. 4,783,396, JP-A-63-201653 and JP-A-63-201654, compounds having an $SO_2$—X bond (X represents the same meaning as above) and an electron attractive group in one molecule disclosed in JP-A-1-26842, compounds having a PO—X bond (X represents the same meaning as above) and an electron attractive group in one molecule disclosed in JP-A-63-271344, and compounds having a C—X' bond (X' represents the same meaning as X or —$SO_2$—) and an electron attractive group in one molecule disclosed in JP-A-63-271341. In addition, compounds which release a diffusible dye by the cleavage of a single bond after being reduced by a π bond conjugated with an electron accepting group disclosed in JP-A-1-161237 and JP-A-1-161342 can also be used.

Of the above, compounds having an N—X bond and an electron attractive group in one molecule are particularly preferred. Specific examples of such compounds are Compounds (1) to (3), (7) to (10), (12), (13), (15), (23) to (26), (31), (32), (35), (36), (40), (41), (44), (53) to (59), (64) and (70) disclosed in EP-A-220746, and Compounds (11) to (23) disclosed in *JIII Journal of Technical Disclosure* (Kokai Giho) 87-6199.

(iv) Couplers which have a diffusible dye as a releasing group and release the diffusible dye by the reaction with the oxidized product of a reducing agent (DDS couplers). Specific examples are disclosed in British Patent 1,330,524, JP-B-48-39165, U.S. Pat. Nos. 3,443,940, 4,474,867 and 4,483,914.

(v) Compounds which are reductive against silver halide and organic silver salt and release a diffusible dye when the object is reduced (DRR compounds). These compounds are preferred became the problem of the contamination of an image by the oxidized decomposed product of a reducing agent does not arise because no other reducing agents are required. Representative examples thereof are disclosed in U.S. Pat. Nos. 3,928,312, 4,053,312, 4,055,428, 4,336,322, JP-A-59-65839, JP-A-59-69839, JP-A-53-3819, JP-A-51-104343, RD, No. 17465, U.S. Pat. Nos. 3,725,062, 3,728,113, 3,443,939, JP-A-58-116537, JP-A-57-179840, and U.S. Pat. No. 4,500,626. Specific examples of DRR compounds are disclosed in columns 22 to 44 of U.S. Pat. No. 4,500,626, and Compounds (1) to (3), (10) to (13), (16) to (19), (28) to (30), (33) to (35), (38) to (40), and (42) to (64) disclosed in the above patent are preferred above all. Compounds disclosed in columns 37 to 39 of U.S. Pat. No. 4,639,408 are also useful.

c) Organic or Inorganic Dye or Pigment

Dyes or pigments for use in the present invention include organic or inorganic dyes or pigments, such as azo based, azomethine based, oxonol based, cyanine based, phthalocyanine based, quinacridone based, anthraquinone based, dioxazine based, indigo based, perynone.perylene based, titanium oxide, iron oxide based, chromium oxide, carbon black, or the other dyes or pigments. In addition, any of known dyes conventionally used as coloring agents and mixtures thereof can be used. In the present invention, these dyes or pigments can be used in any form such as in an aqueous pasty state immediately after production or in a powdery state. Oil-soluble dyes disclosed in U.S. Pat. No. 4,420,555, JP-A-61-204630 and JP-A-61-205934 can also be used.

Useful dyes for use in the present invention may be any of various known dyes having structures such as an arylidene compound, a heterocyclic arylidene compound, anthraquinones, triarylmethanes, an azomethine dye, an azo dye, a cyanine dye, a merocyanine dye, an oxonol dye, a styryl dye, a phthalocyanine dye, an indigo dye or the like.

The arylidene compound is of the structure in which an acid nucleus and an aryl group are bonded by one or more methine groups.

Examples of the acid nucleus include 2-pyrazolin-5-one, 2-isooxazolin-5-one, barbituric acid, 2-thiobarbituric acid, benzoylacetonitrile, cyanoacetamide, cyanoacetanilide, cyanoacetate, malonate, malondianilide, dimedone, benzoylacetanilide, pivaloylacetanilide, malononitrile, 1,2-dihydro-6-hydroxypyridin-2-one, pyrazolidine-3,5-dione, pyrazolo[3,4-b]pyridine-3,6-dione, indane-1,3-dione, hydantoin, thiohydantoin, 2,5-dihydrofuran-2-one, etc.

Examples of the aryl group include a phenyl group, which is preferably substituted with an electron donative group such as an alkoxyl group, a hydroxyl group, an amino group, etc.

The heterocyclic arylidene compound is of the structure in which an acid nucleus and a heterocyclic aromatic ring are bonded by one or more methine groups.

Examples of the acid nucleus are the same as described above.

Examples of the heterocyclic aromatic ring include pyrrole, indole, furan, thiophene, pyrazole, coumalin, etc.

The anthraquinones represent anthraquinones substituted with an electron donative group or an electron attractive group.

The triarylmethanes represent compounds having the structure in which three substituted aryl groups (they may be the same or different) are bonded to one methine group, e.g., phenolphthalein.

The azomethine dye is a dye of the structure in which an acid nucleus and an aryl group are linked by an unsaturated nitrogen linking group (an azomethine group). Examples of acid nuclei include those known as photographic couplers in addition to the above. Indoanilines also belong to an azomethine dye.

The azo dye represents an azo dye of the structure in which aryl groups or heterocyclic aromatic groups are linked by an azo group.

The cyanine dye represents a cyanine dye in which two basic nuclei are bonded by one or more methine groups. Examples of basic nuclei include a quaternary salt, such as oxazole, benzoxazole, thiazole, benzothiazole, benzimidazole, quinoline, pyridine, indolenine, benzindolenine, benzoselenazole, imidazoquinoxaline, etc., and pyrylium.

The merocyanine dye represents a merocyanine dye in which the above basic nucleus and an acid nucleus are bonded by a double bond, or bonded by one or more methine groups.

The oxonol dye is an oxonol dye in which two of the above acid nuclei are bonded by a methine group(s) of one, or an odd number of three or more.

The styryl dye is a styryl dye in which the above basic nucleus and an aryl group are bonded by two or four methine groups.

The phthalocyanine may be or may not be coordinated with a metal.

The indigo may be a substituted or unsubstituted indigo and thioindigo is also included.

When oil-soluble dyes are used as a filter dye or an antihalation dye, an effective arbitrary amount can be selected but they are preferably used in the amount such that the optical density falls within the range of from 0.05 to 3.5. The time of addition may be at any stage before coating.

Specific addition amount of these dye varies depending on the kinds of dyes, dispersion polymers or dispersing methods, but is generally from $10^{-3}$ g/m$^2$ to 3.0 g/m$^2$, and particularly preferably from $10^{-3}$ g/m$^2$ to 1.0 g/m$^2$.

d) Oil for Dispersion

A high boiling point organic substance (an oil for dispersion) substantially insoluble in water and having a boiling point of 190° C. or more at atmospheric pressure is preferably used for controlling the precipitation of crystals when a water-insoluble photographically useful compound is finely dispersed in an aqueous medium. In addition, it is sometimes required to include an emulsified dispersion of a high boiling point organic substance (an oil for dispersion) for various purposes, such as the adjustment of the modulus of elasticity of the film constituting a photographic element, the capture of oil-soluble substances, the adjustment of contact capability or adhesive capability. Such organic substance can be selected from among carboxylates, phosphates, carboxylic acid amides, ethers, phenols, anilines, substituted hydrocarbons, and surface inactive hydrophobic organic polymers. Specific examples include di-n-butyl phthalate, diisooctyl phthalate, dicyclohexyl phthalate, dimethoxyethyl phthalate, di-n-butyl adipate, diisooctyl azelate, tri-n-butyl citrate, butyl laurate, di-n-butyl sebacate, tricyclohexyl phosphate, tri-n-butyl phosphate, triisooctyl phosphate, N,N-diethylcaprylic acid amide, N,N-dimethylpalmitic acid amide, n-butyl(m-pentadecyl)phenyl ether, ethyl(2,4-di-tert-butyl)phenyl ether, 2,5-di-tert-amylphenol, 2-n-butoxy-5-tert-octylaniline, paraffin chloride, poly(methyl methacrylate), poly(ethyl methacrylate), poly(ethyl acrylate), poly (cyclohexyl methacrylate, poly(N-tert-butylacrylamide) and poly(N-tert-octylacrylamide).

The above oils for dispersion may be used in combination with a low boiling point organic solvent which is immiscible with water (having a boiling point of 130° C. or less at 1 atm.) or an organic solvent which is miscible with water. For increasing the stability of the dispersion obtained, a water-immiscible or water-miscible organic solvent, which is used for dissolving a photographically useful compound to make a solution, may be removed by distillation, preferably distillation under reduced pressure or ultrafiltration, or by other known methods.

Examples of such organic solvents include, e.g., propylene carbonate, methyl acetate, ethyl acetate, isopropyl acetate, butyl acetate, ethyl propionate, sec-butyl alcohol, methyl ethyl ketone, 2-pentanone, 3-pentanone, cyclohexanone, dimethylformamide, and dimethyl sulfoxide. A preferred addition amount of organic solvents is from 0.1 to 100 times of the weight of the water-insoluble photographically useful compound to be dispersed.

e) Latex

Examples of monomers for polymer latexes for use in the present invention include, e.g., acrylate, methacrylate, crotonate, vinyl ester, maleic diester, fumaric diester, itaconic diester, acrylamides, methacrylamides, vinyl ethers, styrenes, etc.

Specific examples of these monomers include: as acrylate, methyl acrylate, ethyl acrylate, n-propyl acrylate, isopropyl acrylate, n-butyl acrylate, isobutyl acrylate, tert-butyl acrylate, hexyl acrylate, 2-ethylhexyl acrylate, acetoxyethyl acrylate, phenyl acrylate, 2-methoxy acrylate, 2-ethoxy acrylate, and 2-(2-methoxyethoxy)ethyl acrylate; as methacrylate, methyl methacrylate, ethyl methacrylate, n-propyl methacrylate, n-butyl methacrylate, tert-butyl methacrylate, cyclohexyl methacrylate, 2-hydroxyethyl methacrylate, and 2-ethoxyethyl methacrylate; as crotonate, butyl crotonate and hexyl crotonate; as vinyl ester, vinyl acetate, vinyl propionate, vinyl butyrate, vinyl methoxyacetate, and vinyl benzoate; as maleic diester, diethyl maleate, dimethyl maleate, and dibutyl maleate; as fumaric diester, diethyl fumarate, dimethyl fumarate, and dibutyl fumarate; and as itaconic diester, diethyl itaconate, dimethyl itaconate, and dibutyl itaconate.

As acrylamides, acrylamide, methylacrylamide, ethylacrylamide, propylacrylamide, n-butylacrylamide, tert-butylacrylamide, cyclohexylacrylamide, 2-methoxyethylacrylamide, dimethylacrylamide, diethylacrylamide, and phenylacrylamide; as methacrylamides, methylmethacrylamide, ethylmethacrylamide, n-butylmethacrylamide, tert-butylmethacrylamide, 2-methoxymethacrylamide, dimethylmethacrylamide, and diethylmethacrylamide; as vinyl ethers, methyl vinyl ether, butyl vinyl ether, hexyl vinyl ether, methoxyethyl vinyl ether, and dimethylaminoethyl vinyl ether; and as styrenes, styrene, methylstyrene, dimethylstyrene, trimethylstyrene, ethylstyrene, isopropylstyrene, butylstyrene, chloromethylstyrene, methoxystyrene, butoxystyrene, acetoxystyrene, chlorostyrene, dichlorostyrene, bromostyrene, methyl vinyl benzoate, and 2-methylstyrene can be cited.

Polymers consisting of these monomers may be homopolymers or copolymers. Binary or ternary copolymers of acrylate, methacrylate, styrenes, acrylic acid and methacrylic acid; copolymers of styrenes and butadiene; and polyvinylidene chlorides are preferably used.

In a photographic element of the system of transferring the mobile dye released by development into an image-receiving element, a dye-capturing agent is incorporated into the photographic element as follows.

(1) A dye-capturing agent is incorporated into a dye element as a dye-fixing agent (a mordant).

(2) A dye-capturing agent is incorporated into an interlayer or a protective layer in a photographic element for the purpose of lowering Dmin (the density of white background).

(3) A dye-capturing agent (in particular, a tertiary amine type polymer latex) is incorporated into a processing solution (into a pod) of a diffusion transfer type color instant photographic element for the purpose of preventing post-transfer of a dye.

A water-soluble polymer mordant, an oil-soluble polymer mordant, and a latex mordant are preferably used as a dye-capturing agent in these uses, in particular, a polymer latex mordant is preferably used for the above uses (2) and (3).

The polymer mordants herein means polymers containing a tertiary amino group, polymers having a nitrogen-containing heterocyclic moiety, and polymers containing quaternary cationic groups of these compounds. Further, a polymer mordant containing imidazole or a derivative group thereof is superior in light fastness and preferably used.

Polymers containing a vinyl monomer unit having a tertiary amine group are disclosed in JP-A-60-60643 and JP-A-60-57836, and specific examples of polymers containing a vinyl monomer unit having a tertiary imidazole group are disclosed in JP-A-60-118834, JP-A-60-122941, JP-A-62-244043, JP-A-62-244036, U.S. Pat. Nos. 4,282,305, 4,115,124 and 3,148,061.

Specific examples of polymers containing a vinyl monomer unit having a quaternary imidazolium salt are disclosed in British Patents 2;056,101, 2,093,041, 1,594,961, U.S. Pat. Nos. 4,124,386, 4,115,124, 4,273,853, 4,450,224, and JP-A-48-28225.

In addition, specific examples of polymers containing a vinyl monomer unit having a quaternary ammonium salt are disclosed in U.S. Pat. Nos. 3,709,690, 3,898,088, 3,958,995, JP-A-60-57836, JP-A-60-60643, JP-A-60-122940, JP-A-60-122942 and JP-A-60-235134.

Free radical polymerization of an ethylenically unsaturated solid monomer is initiated by the addition to the molecule of a monomer of a free radical formed by thermal decomposition of a chemical initiator, function of a reducing agent (a redox initiator) in an oxidizing compound, or physical function, e.g., radiation of ultraviolet ray or other high energy, high frequency, etc.

Examples of primary chemical initiators include persulfate (ammonium and potassium persulfate), hydrogen peroxide, 4,4'-azobis(4-cyanovalerianic acid) (these are water-soluble), azoisobutyronitrile, benzoyl peroxide, chlorobenzoyl peroxide, and other compounds (these are water-insoluble).

Usual redox initiators include hydrogen peroxide-ferrous salt, potassium persulfate-potassium bisulfate, cerium salt alcohol, etc.

Examples and functions thereof of initiators are described in F. A. Bovey, *Emulsion Polymerization*, pp. 59 to 93, Interscience Publishes Inc;, New York (1955).

A compound having surface activity is used as an emulsifying agent, preferably a soap, sulfonate, sulfate, a cationic compound, an amphoteric compound, and high molecular protective colloid are cited. Examples of these groups and functions are described in *Belgische Chemische Industrie*, Vol. 28, pp. 16 to 20 (1963).

Specific examples of polymer latexes which can be used in the present invention are shown below, but the present invention is not limited thereto.

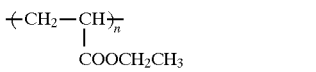

(L-1) Tg = −21° C.

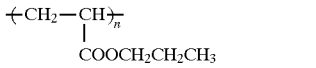

(L-2) Tg = −36° C.

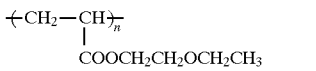

(L-3) Tg = −47° C.

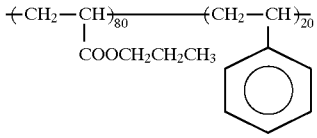

(L-4) Tg = −20° C.

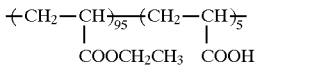

(L-5) Tg = −11° C.

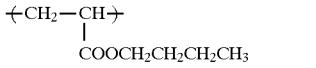

(L-6) Tg = −53° C.

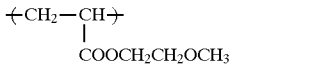

(L-7) Tg = −45° C.

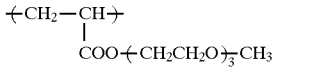

(L-8) Tg = −36° C.

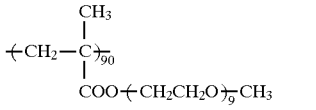

(L-9) Tg = −18° C.

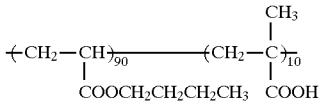

(L-10) Tg = −26° C.

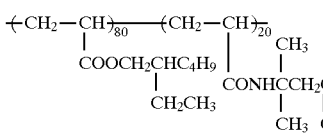

(L-11) Tg = −17° C.

-continued

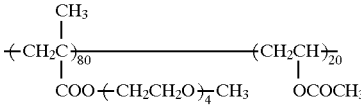

(L-12) Tg = −4° C.

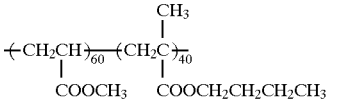

(L-13) Tg = 15° C.

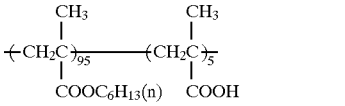

(L-14) Tg = 6° C.

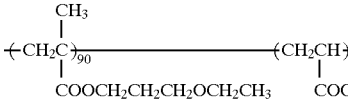

(L-15) Tg = −2° C.

(Polymerization ratio indicates mol %.)

Specific examples of polymer latex mordants

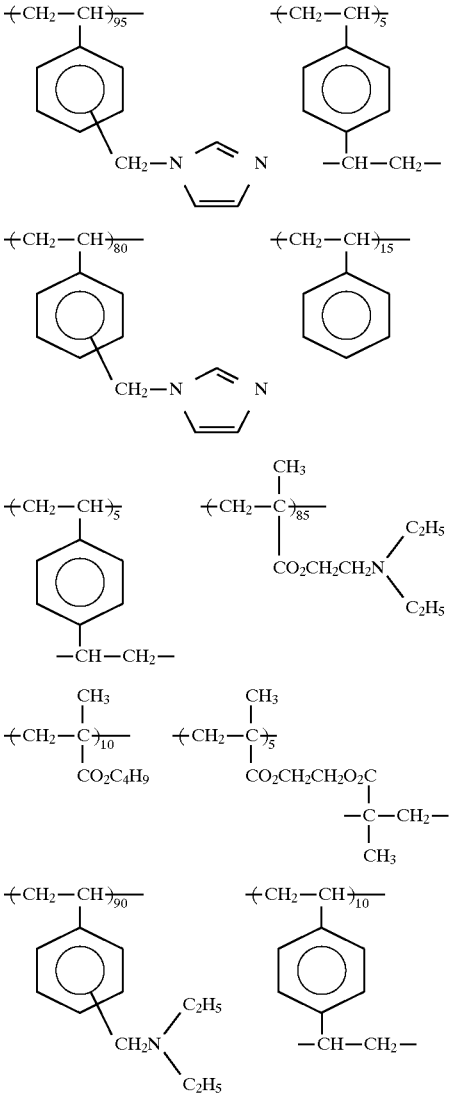

-continued

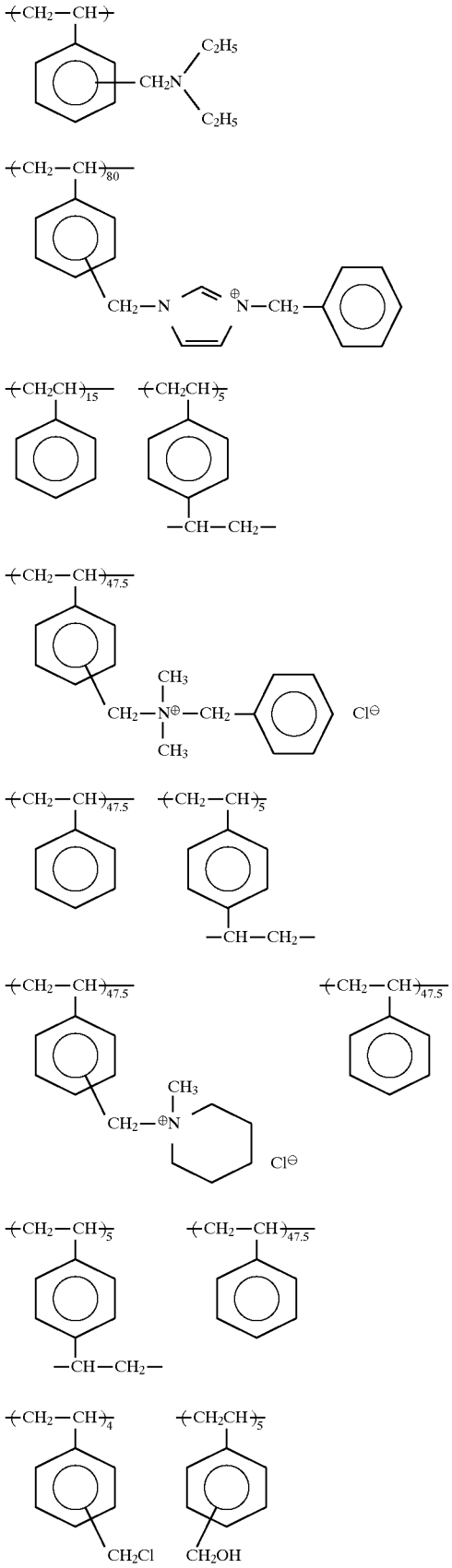

-continued

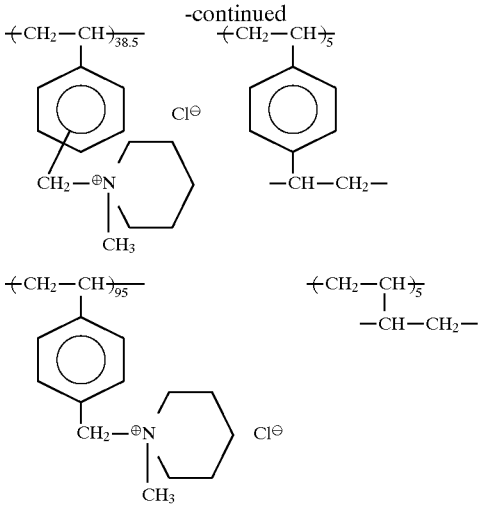

f) Silver Halide and Organic Silver Salt

Silver halide which can be used in the present invention may be any of silver chloride, silver bromide, silver iodobromide, silver chlorobromide, silver chloroiodide, and silver chloroiodobromide.

A silver halide emulsion for use in the present invention may be of a surface latent image type or of an internal latent image type. The internal latent image type emulsion is used as a direct reversal emulsion by combining a nucleating agent and light fogging. The emulsion may be a so-called core/shell type emulsion in which the interior and surface of the grains may be comprised of different phases. Silver halide emulsion may be monodisperse or polydisperse or monodisperse emulsion may be used in admixture. A grain size is from 0.1 to 2 $\mu$m, particularly preferably from 0.2 to 1.5 $\mu$m. Silver halide grain may have a cubic form, an octahedral form, a tetradecahedral form, a tabular form of high aspect ratio, or any other form.

Specifically, any of silver halide emulsions disclosed in U.S. Pat. Nos. 4,500,626, column 50, 4,628,021, RD, No. 17029 (1978) and JP-A-62-253159 can be used.

Silver halide emulsions may be used without after-ripening but is generally chemically sensitized. In ordinary emulsions for light-sensitive materials, known sulfur sensitization, reduction sensitization, noble metal sensitization and selenium sensitization, etc., can be used alone or in combination. These chemical sensitization can be conducted in the presence of a nitrogen-containing heterocyclic compound (ref. JP-A-62-253159).

The coating amount of the light-sensitive silver halide for use in the present invention is from 1 mg/m$^2$ to 10 g/m$^2$, calculated in terms of silver.

Silver halide for use in the present invention may be spectrally sensitized by methine dyes and the like, examples thereof include a cyanine dye, a merocyanine dye, a complex cyanine dye, a complex merocyanine dye, a holopolar cyanine dye, a hemicyanine dye, a styryl dye, and a hemioxonol dye Specifically, sensitizing dyes disclosed in U.S. Pat. No. 4,617,257, JP-A-59-180550, JP-A-60-140335, and RD, No. 17029 (1978), pp. 12 and 13 can be cited.

These sensitizing dyes may be used alone or in combination. A combination of sensitizing dyes is often used for the purpose of supersensitization.

Dyes which themselves do not have a spectral sensitizing function or compounds which substantially do not absorb visible light but show supersensitization can be incorporated in the emulsion with sensitizing dyes (e.g., those disclosed in U.S. Pat. No. 3,615,641 and JP-A-63-23145).

These sensitizing dyes may be added to an emulsion before, during or after chemical ripening, alternatively they may be added before or after nucleation of silver halide grains according to U.S. Pat. Nos. 4,183,756 and 4,225,666. The addition amount is, in general, from $10^{-8}$ to $10^{-2}$ mol per mol of the silver halide.

When the light-sensitive element according to the present invention is processed in heat development, organic metal salts may be used as an oxidant in combination with light-sensitive silver halide. Of such organic metal salts, organic silver salt is particularly preferably used.

Examples of compounds which can be used for forming the above organic silver salt oxidant include benzotriazoles, fatty acid, and other compounds disclosed in U.S. Pat. No. 4,500,626, columns 52 and 53. The silver salt of carboxylic acid having an alkynyl group such as phenylpropiolic acid silver disclosed in JP-A-60-113235 and acetylene silver disclosed in JP-A-61-249044 are also useful. Two or more organic silver salts may be used in combination.

The above organic silver salts can be used in combination in an amount of from 0.01 to 10 mol, preferably from 0.01 to 1 mol, per mol of the light-sensitive silver halide. The total coating amount of the light-sensitive silver halide and the organic silver salt is appropriately from 50 mg/$m^2$ to 10 g/$m^2$ calculated in terms of silver.

g) Reducing Agent

Other photographically useful compound which can be used in the present invention is a reducing agent and reducing agents known in the photographic field can be used. In addition, the dye donative compounds having reductivity described above can be included in the reducing agent (in such a case, other reducing agents can be used in combination). Further, reducing agent precursors which themselves do not have reductivity but show reductivity during the process of development by the action of a nucleophilic reagent or heat can also be used.

Examples of reducing agents which can be used in the present invention include reducing agents and reducing agent precursors disclosed in U.S. Pat. Nos. 4,500,626, columns 49 and 50, 4,483,914, columns 30 and 31, 4,330,617, 4,590,152, JP-A-60-140335, pp. 17 and 18, JP-A-57-40245, JP-A-56-138736, JP-A-59-178458, JP-A-59-53831, JP-A-59-182449, JP-A-59-182450, JP-A-60-119555, from JP-A-60-128436 to JP-A-60-128439, JP-A-60-198540, JP-A-60-181742, JP-A-61-259253, JP-A-62-244044, from JP-A-62-131253 to JP-A-62-131256, and EP-A-220746, pp. 78 to 96.

Combinations of various reducing agents as disclosed in U.S. Pat. No. 3,039,869 can also be used.

When diffusion resisting reducing agents are used, if required, an electron transferring agent and/or a precursor of an electron transferring agent can be used in combination to accelerate electron transfer between a diffusion resisting reducing agent and developable silver halide.

The electron transferring agent or the precursor thereof can be selected from among the above-described reducing agents or precursors thereof. It is preferred for the electron transferring agent or the precursor thereof to have transferability larger than that of the diffusion resisting reducing agent (an electron donor). Particularly preferred electron transferring agents are 1-phenyl-3-pyrazolidones or aminophenols.

In the above-described reducing agents, diffusion resisting reducing agents (electron donors) to be used in combination with an electron transferring agent are those substantially not to transfer in the layer of a photographic element, preferably hydroquinones, sulfonamidophenols, sulfonamidonaphthols, compounds disclosed in JP-A-53-110827 as electron donors, and the above-described diffusion resisting dye donative compounds having reductivity can be cited.

The addition amount of reducing agents is from 0.001 to 20 mols, particularly preferably from 0.01 to 10 mols, per mol of silver.

Reducing agents may be incorporated into a light-sensitive element, or may be contained in a rupturable container as a component of a processing composition and supplied to a light-sensitive element (and a dye-fixing element) at processing time. The former is suitable for heat development processing and the latter is preferably adopter for a color diffusion transfer process in which processing is conducted at room temperature.

h) Other Photographically Useful Compounds

Examples of other photographically useful compounds which can be used in the present invention include an antifoggant and a development inhibitor represented by, e.g., mercaptotetrazoles, mercaptotriazoles, mercaptopyrimidines, mercaptobenzimidazoles, mercaptothiadiazoles, benzotriazoles, imidazoles, etc.; a developer such as p-phenylenediamines, hydroquinones, p-aminophenols, etc.; a developing adjuvant, e.g., pyrazolidones; a nucleating agent, e.g., hydrazines, hydrazides, etc.; a silver halide solvent, e.g., hypo, etc.; a bleaching accelerator, e.g., aminoalkylthiols, etc.; and dyes, e.g., an azo dye, an azomethine dye, etc. In addition, precursors of the above photographically useful compounds, compounds having a redox function capable of releasing the above photographically useful compounds with the progress of development, e.g., in addition to the above-described dye compounds for a color diffusion transfer light-sensitive element, DIR- or DAR-hydroquinones can also be cited as photographically useful compounds.

These photographically useful compounds can be bonded via a timing group and examples of such timing groups include groups which release a photographically useful compound by the intramolecular ring closing reaction as disclosed in JP-A-54-145135, groups which release a photographically useful compound by the intramolecular electron transfer as disclosed in British Patent 2,072,363 and JP-A-57-154234, groups which release a photographically useful compound being accompanied by the separation of carbon dioxide gas as disclosed in JP-A-57-179842, and groups which release a photographically useful compound being accompanied by the separation of formaldehyde as disclosed in JP-A-59-93442.

As a method for dispersing a water-insoluble photographically useful compound of the above photographically useful compounds, a representative method is an oil-in-water dispersion method using a high boiling point solvent in the presence of a dispersant.

Specifically, a dispersion can be prepared by mixing a water-insoluble photographically useful compound, which is maintained at a solution state by any of the following methods, with water or a hydrophilic colloid aqueous solution in the presence of a dispersant. The following dispersers can be used for further finely dispersing dispersion grains, if necessary.

As dispersers, there are high speed agitating type dispersers having high shearing force, and dispersers applying superhigh ultrasonic energy. Specifically, a colloid mill, a homogenizer, a capillary type emulsifying apparatus, a liquid siren, an electromagnetic skewing type ultrasonic wave generator, and an emulsifying apparatus equipped with a Paulman whistle. High speed agitating type dispersers preferably used in the present invention are dispersers whose main part bearing dispersing function rotates at a high speed in a solution (from 500 to 15,000 rpm, preferably from 2,000 to 4,000 rpm) such as a dissolver, a Polytron, a homomixer, a homoblender, a Keddy mill, and a jet agitator. High speed agitating type dispersers for use in the present invention are called a dissolver or a high speed impeller disperser, and the disperser equipped with an impeller comprising an axle rotating at a high speed equipped with serrated blades bent upward and downward alternately as disclosed in JP-A-55-129136 is one preferred example.

The method disclosed in an International patent publication WO 93/3420 is also useful to obtain a finely emulsified dispersion of a water-insoluble photographically useful compound in which the compound is finely dispersed with an increased amount of surfactant and an excessive amount of surfactant is removed from the dispersion by washing with water (because surfactant is not preferred photographically, physically and from manufacturing suitability). In this case, when the above dispersion solution is added to a coating solution or when a coating solution added with the dispersion is stored in a solution state, it is particularly preferred to add a modified polyvinyl alcohol having a terminal hydrophobic group or a modified product thereof disclosed in JP-A-8-62802 to the dispersion solution to prevent the agglomeration or precipitation of the above water-insoluble photographically useful compound.

An auxiliary solvent and a surfactant can be removed by known methods as disclosed in, e.g., U.S. Pat. Nos. 2,322,027, 2,801,171, 2,946,360, 3,396,027 and 4,233,397.

Moreover, precipitation dispersion can be carried out by dissolving a water-insoluble photographically useful compound in acid, alkali or a water-miscible organic solvent or mixtures of them, and neutralizing the dissolved product in the presence of a polymer dispersant such as a modified polyvinyl alcohol having a terminal hydrophobic group or a modified product thereof as disclosed in JP-A-8-62802, or by mixing with water. According to this method, representative examples when applied to a photographic color coupler are disclosed in British Patent 1,193,349, U.S. Pat. Nos. 4,957,857 and 4,933,270, and examples when applied to other water-insoluble photographically useful compounds are disclosed in JP-A-4-163453.

Further, when a water-insoluble photographically useful compound is a solid, a finely grained solid dispersion can be directly obtained using a medium for dispersion in the presence of water and a dispersant.

As a representative example thereof, the solid dye dispersion disclosed in an International patent publication WO 88/04794 can be cited. In addition, this method is preferably applied to a pigment such as carbon black and titanium oxide.

As dispersion by a medium, a method of mechanical dispersion using a ball mill, a sand grinder mill or a colloid mill is general.

A water-insoluble photographically useful compound can be filled in a water-soluble polymer latex and incorporated into a photographic element. Methods of dispersion using a polymer latex are disclosed in U.S. Pat. No. 4,199,363, West German Patent Applications (OLS) 2,541,274 and 2,541,230.

Binders or protective colloid generally used in a silver halide photographic element are used as hydrophilic colloid in a hydrophilic colloid composition for use in the present invention.

Gelatin is preferably used as a binder or protective colloid for a photographic emulsion, but other hydrophilic colloids can also be used. Examples thereof include proteins such as gelatin derivatives, graft polymers of gelatin and other high polymers, proteins such as albumin and casein; sugar derivatives such as cellulose derivatives such as hydroxyethyl cellulose, carboxymethyl cellulose, and cellulose sulfate, sodium alginate, and starch derivatives; and various kinds of synthetic hydrophilic high polymers of homopolymers or copolymers such as polyvinyl alcohol, partially acetalated polyvinyl alcohol, poly-N-vinylpyrrolidone, polyacrylic acid, polymethacrylic acid, polyacrylamide, polyvinylimidazole, and polyvinylpyrazole.

Acid-processed gelatin can be used as well as lime-processed gelatin, and hydrolyzed product of gelatin and enzyme decomposed product of gelatin can also be used. As gelatin derivatives, products obtained by reacting gelatin with various compounds, e.g., acid halide, acid anhydride, isocyanates, bromoacetic acid, alkane sultones, vinyl sulfonamides, maleinimide compounds, polyalkylene oxides, and epoxy compounds can be used.

The swellable inorganic stratifying compound according to the present invention can be used in a photographic material making use of silver halide as a light sensor or in various photographic elements which are used in combination with such a material.

For example, the technique of the present invention can be applied to a silver halide black-and-white or color photographic material which is wet processed, a silver halide black-and-white or color photographic material which is heat development processed, a silver halide black-and-white or color photographic material which is wet processed by a diffusion transfer technique, a silver halide black-and-white or color photographic material which is heat development processed by a diffusion transfer technique, a photographic element which is used in combination with these photographic materials (e.g., a processing sheet having a function of supplying necessary components to a photographic material and/or a function of removing components which become unnecessary by processing from-a photographic material, a receiving element of image-forming substances (called an image-receiving element, or a dye-fixing element in the case of a dye diffusion transfer process), such as silver ion or a dye imagewise diffusing from a photographic material), etc. A photographic element may be in the form of a roll or a sheet.

Classifying these photographic material by uses, a black-and-white photographic material, an X-ray photographic material, a lithographic material, a dry silver material, a color negative film, a color reversal film, a color print material, a color and black-and-white instant photographic material, a color and black-and-white heat developing material, and others.

Preferred examples of silver halide emulsions, other substances (additives or the like) and photographic constitutional layers (arrangement of the layers or the like) applied to the photographic element for use in the present invention, processing methods for processing the photographic element and additives for the processing are disclosed in the patent publications described below, in particular, those disclosed in EP-A-355660 (corresponding to JP-A-2-139544) are preferably used.

TABLE 1

| Photographic Constitutional Element | JP-A-62-215272 | JP-A-2-33144 | EP-A-355660 |
|---|---|---|---|
| Silver Halide Emulsion | p. 10, right upper column, l 6 to p. 12, left lower column, l. 5, | p. 28, right upper column, l. 16 to p. 29, right lower column, l. 11 | p. 45, l 53 to p. 47, l. 3 |
| | p. 12, right lower column, 4 line up from the bottom to p. 13, left upper column, l. 17 | p. 30, ll. 2 to 5 | p. 47, ll. 20 to 22 |
| Silver Halide Solvent | p. 12, left lower column, ll. 6 to 14<br>p. 13, left upper column, 3 line up from the bottom to p. 18, left lower column, last line | — | — |
| Chemical Sensitizer | p. 12, left lower column, 3 line up from the bottom to right lower column, 5 line up from the bottom<br>p. 18, right lower column, l. 1 to p. 22, right upper column, 9 line up from the bottom | p. 29, right lower column, l. 12 to last line | p. 47, ll. 4 to 9 |
| Spectral Sensitizer (spectral sensitizing method) | p. 22, right upper column, 8 line up from the bottom to p. 38, last line | p. 30, left upper column, ll. 1 to 13 | p. 47, ll. 10 to 15 |

TABLE 2

| Photographic Constitutional Element | JP-A-62-215272 | JP-A-2-33144 | EP-A-355660 |
|---|---|---|---|
| Color Coupler (cyan, magenta, and yellow) | p. 91, right upper column, l. 4 to p. 121, left upper column, l. 6 | p. 3, right upper column, l. 14 to p. 18, left upper column, last line<br>p. 30, right upper column, l. 6 to p. 35, right lower column, l. 11 | p. 4, ll. 15 to 27<br>p. 5, l. 30 to p. 28, last line<br>p. 45, ll. 29 to 31<br>p. 47, l. 23 to p. 63 l. 50 |
| Color Intensifier | p. 121, left upper column, l. 7 to p. 125, right upper column, l. 1 | — | — |
| UV Absorber | p. 125, right upper column, l. 2 to p. 127, left lower column, last line | p. 37, right lower column, l. 14 to p. 38, left upper column, l. 11 | p. 65, ll. 22 to 31 |
| Discoloration Inhibitor (image stabilizer) | p. 127, right lower column, l. 1 to p. 137, left lower column, l. 8 | p. 36, right upper column, l. 12 to p. 37, left upper column, l. 19 | p. 4, l. 30 to p. 5, l. 23<br>p. 29, l. 1 to p. 45, l. 25<br>p. 45, ll. 33 to 40<br>p. 65, ll. 2 to 21 |
| High Boiling Point and/or Low Boiling Point Organic Solvent | p. 137, left lower column, l. 9 to p. 144, right upper column, last line | p. 35, right lower column, l. 14 to p. 36, left upper column, 4 line up from the bottom | p. 64, ll. 1 to 51 |

TABLE 2-continued

| Photographic Constitutional Element | JP-A-62-215272 | JP-A-2-33144 | EP-A-355660 |
|---|---|---|---|
| Dispersing Method of Photographic Additives | p. 144, left lower column, l. 1 to p. 146, right upper column, l. 7 | p. 27, right lower column, l. 10 to p. 28, left upper column, last line<br>p. 35, right lower column, l. 12 to p. 36, right upper column, l. 7 | p. 63, l. 51 to p. 64, l. 56 |

TABLE 3

| Photographic Constitutional Element | JP-A-62-215272 | JP-A-2-33144 | EP-A-355660 |
|---|---|---|---|
| Hardening Agent | p. 146, right upper column, l. 8 to p. 155, left lower column, l. 4 | — | — |
| Developing Agent Precursor | p. 155, left lower column, l. 5 to p. 155, right lower column, l. 2 | — | — |
| DIR Compound | p. 155, right lower column, ll. 3 to 9 | — | — |
| Support | p. 155, right lower column, l. 19 to p. 156, left upper column, l. 14 | p. 38, right upper column, l. 18 to p. 39, left upper column, l. 3 | p. 66, l. 29 to p. 67, l. 13 |
| Layer Structure of Photographic Material | p. 156, left upper column, l. 15 to p. 156, right lower column, l. 14 | p. 28, right upper column, ll. 1 to 15 | p. 45, ll. 41 to 52 |
| Dye | p. 156, right lower column, l. 15 to p. 184, right column, last line | p. 38, left upper column, l. 12 to right upper column, l. 7 | p. 66, ll. 18 to 22 |
| Color Mixture Preventive | p. 185, left upper column, l. 1 to p. 188, right lower column, l. 3 | p. 36, right upper column, ll. 8 to 11 | p. 64, l. 57 to p. 65, l. 1 |
| Gradation Controlling Agent | p. 188, right lower column, ll. 4 to 8 | — | — |
| Antistaining Agent | p. 188, right lower column, l. 9 to p. 193, right lower column, l. 10 | p. 37, left upper column, last line to right lower column, l. 13 | p. 65, l. 32 to p. 66, l. 17 |

TABLE 4

| Photographic Constitutional Element | JP-A-62-215272 | JP-A-2-33144 | EP-A-355660 |
|---|---|---|---|
| Surfactant | p. 201, left lower column, l. 1 to p. 210, right upper column, last line | p. 18, right upper column, l. 1 to p. 24, right lower column, last line<br>p. 27, left lower column, 10 line up from the bottom to right lower column, l. 9 | — |

TABLE 4-continued

| Photographic Constitutional Element | JP-A-62-215272 | JP-A-2-33144 | EP-A-355660 |
|---|---|---|---|
| Fluorine-Containing Compound (as antistatic agent, coating aid, lubricant, adhesion preventive agent) | p. 210, left lower column, l. 1 to p. 222, left lower column, l. 5 | p. 25, left upper column, l. 1 to p. 27, right lower column, l. 9 | — |
| Binder (hydrophilic colloid) | p. 222, left lower column, l. 6 to p. 225, left upper column, last line | p. 38, right upper column, ll. 8 to 18 | p. 66, ll. 23 to 28 |
| Thickener | p. 225, right upper column, l. 1 to p. 227, right upper column, l. 2 | — | — |
| Antistatic Agent | p. 227, right upper column, l. 3 to p. 230, left upper column, l. 1 | — | — |
| Polymer Latex | p. 230, left upper column, l. 2 to p. 239, last line | — | — |
| Matting Agent | p. 240, left upper column, l. 1 to p. 240, right upper column, last line | — | — |

TABLE 5

| Photographic Constitutional Element | JP-A-62-215272 | JP-A-2-33144 | EP-A-355660 |
|---|---|---|---|
| Photographic Processing Method (processing step and additives) | p. 3, right upper column, l. 7 to p. 10, right upper column, l. 5 | p. 39, left upper column, l. 4 to p. 42, left upper column, last line | p. 67, l. 14 to p. 69, l. 28 |

Note) References in column JP-A-62-215272 include contents amended by The Amendment dated March 16, 1987, which appears at the end of the Patent Publication.

In a system forming an image by diffusion transfer of a dye, a dye-fixing element (an image-receiving element) is used with a light-sensitive element. A dye-fixing element may be coated on the same support as the support of a light-sensitive element, or may be coated on a different support. The relationships between a light-sensitive element and a dye-fixing element, a support, a white reflecting layer disclosed in U.S. Pat. No. 4,500,625, column 57 can be applied to the present invention.

A dye-fixing element can be provided with an auxiliary layer such as a protective layer, a peeling-off layer, a neutralizing layer, a timing layer, a curl preventive layer and the like. In particular, the provision of a protective layer is useful. The swellable inorganic stratifying compound according to the present invention can be added to any of the above-described layers, but it is particularly preferably added to a protective layer, a peeling-off layer or a curl preventive layer.

Further, in heat development processing, a light-sensitive element and a dye-fixing element do not require a neutralizing layer and a timing layer because so high a pH value is not required.

A plasticizer, a sliding agent, or a high boiling point organic solvent as an improver of peeling capability of a light-sensitive element and a dye-fixing element can be used in structural layers of a light-sensitive element and a dye-fixing element. Specific examples are disclosed on page 25 of JP-A-62-253159 and JP-A-62-245253.

Further, various kinds of silicone oils (every kind of silicone oil from dimethylsilicon oil to modified silicone oil such as dimethylsiloxane having incorporated therein various organic groups) can be used for the above purpose. As examples, various kinds of modified silicone oils described in *Modified Silicone Oils*, pp. 6 to 18B, published by Shin-Etsu Silicone Co. Ltd., in particular, a carboxy-modified silicone oil (trade name: X-22-3710), are useful.

Silicone oils disclosed in JP-A-62-215953 and JP-A-63-46449 are also useful.

A discoloration inhibitor may be used in a light-sensitive element and a dye-fixing element. A discoloration inhibitor includes, e.g., an antioxidant, an ultraviolet absorber or a certain kind of metal complex. Examples of antioxidants include, e.g., a chroman based compound, a coumaran based compound, a phenol based compound (e.g., hindered phenols), a hydroquinone derivative, a hindered amine derivative, and a spiroindane compound. Compounds disclosed in JP-A-61-159644 can also be useful.

Examples of ultraviolet absorbers include a benzotriazole based compound (ref. U.S. Pat. No. 3,533,794, etc.), a 4-thiazolidone based compound (ref. U.S. Pat. No. 3,352,681, etc.), a benzophenone compound (ref. JP-A-46-2784, etc.), and other compounds disclosed in JP-A-54-48535, JP-A-62-136641 and JP-A-61-88256. Further, ultraviolet absorbing polymers disclosed in JP-A-62-260152 are also useful.

Examples of metal complexes include compounds disclosed in U.S. Pat. Nos. 4,241,155, columns 3 to 36 of 4,245,018, columns 3 to 8 of 4,254,195, JP-A-62-174741, pp. 27 to 29 of JP-A-61-88256, JP-A-63-199248, JP-A-1-75568 and JP-A-1-74272.

Examples of useful discoloration inhibitors are disclosed on pp. 125 to 137 of JP-A-62-2125272.

A light-sensitive element and a dye-fixing element may contain a brightening agent. In particular, it is preferred to incorporate a brightening agent into a dye-fixing element or supplied from the outside of a light-sensitive element. Compounds disclosed in K. Veenkataraman, *The Chemistry of Synthetic Dyes*, Vol. V, Chap. 8, and JP-A-61-143752 can be cited as examples. Specifically, a stilbene based compound, a coumalin based compound, a biphenyl based compound, a benzoxazolyl based compound, a naphthalimide based compound, a pyrazoline based compound, and a carbostyril based compound can be cited.

A brightening agent can be used in combination with a discoloration inhibitor.

As a hardening agent for use in structural layers of a light-sensitive element and a dye-fixing element, hardening agents disclosed in column 41 of U.S. Pat. No. 4,678,739, JP-A-59-116655, JP-A-62-245261 and JP-A-61-18942 can be cited. Specifically, an aldehyde based hardening agent (e.g., formaldehyde), an aziridine based hardening agent, an epoxy based hardening agent, a vinyl sulfone based hardening agent (e.g., N,N'-ethylene-bis (vinylsulfonylacetamide)ethane), an N-methylol based hardening agent (e.g., dimethylolurea), or a high polymer hardening agent (e.g., compounds disclosed in JP-A-62-234157) can be enumerated.

Various surfactants can be used in structural layers of a light-sensitive element and a dye-fixing element for various purposes such as coating aid, improvement of peeling-off property, improvement of sliding property, static prevention, and development acceleration. Specific examples of surfactants are disclosed in JP-A-62-173463 and JP-A-62-183457, etc.

An organic fluoro compound can be contained in structural layers of a light-sensitive element and a dye-fixing element for purposes of improvement of sliding property, static prevention, and improvement of peeling-off property. Representative examples of organic fluoro compounds include fluorine based surfactants disclosed in columns 8 to 17 of JP-B-57-9053, JP-A-61-20944 and JP-A-62-135826, and a hydrophobic fluorine compound, such as an oily fluorine based compound such as a fluorine oil, or a solid fluorine compound resin such as a tetrafluoroethylene resin.

A matting agent can be used in a light-sensitive element and a dye-fixing element. As a matting agent, there are compounds such as benzoguanamine resin beads, polycarbonate resin beads, and AS resin beads disclosed in JP-A-63-274944 and JP-A-63-274952, in addition to compounds such as silicon dioxide, polyolefin and polymethacrylate disclosed on p. 29 of JP-A-61-88256.

Moreover, a thermal solvent, a defoaming agent, a fungicide, a biocide, colloidal silica, etc., may be contained in structural layers of a light-sensitive element and a dye-fixing element. Specific examples of these additives are disclosed on pp. 26 to 32 of JP-A-61-88256.

An image-forming accelerator can be used in a light-sensitive element and a dye-fixing element. In particular, an image-forming accelerator is preferably used in heat development processing. An image-forming accelerator has functions of acceleration of the oxidation reduction reaction of a silver salt oxidant and a reducing agent, acceleration of reactions such as dye formation from a dye donative compound, decomposition of a dye, or release of a diffusible dye, and acceleration of dye transfer from a light-sensitive layer to a dye-fixing layer. An image-forming accelerator is classified, from physical chemical functions, into a base, a base precursor, a nucleophilic compound, a high boiling point organic solvent (oil), a thermal solvent, a surfactant, a compound having correlation with silver or silver ion. However, these material groups have, in general, composite function and invested with some of the above acceleration effects. Details thereof are disclosed in columns 38 to 40 of U.S. Pat. No. 4,678,739.

In a system carrying out heat development and dye transfer at the same time in the presence of a small amount of water, it is preferred to include a base and/or a base precursor in a dye fixing element in view of increasing the storage stability of a light-sensitive element.

A base precursor includes an organic acid decarboxylated by heat, salt of a base, a compound releasing amines by intramolecular nucleophilic substitution reaction, Lossen rearrangement, or Beckmann rearrangement. Specific examples are disclosed in U.S. Pat. No. 4,511,493 and JP-A-62-65038.

In addition to the above, hardly-soluble metal compounds, and combinations of compounds which can react with metal ions constituting these hardly-soluble metal compounds to form complexes (complex-forming compounds) disclosed in EP-A-210660 and U.S. Pat. No. 4,740,445, and compounds which generate a base by electrolysis disclosed in JP-A-61-232451 can also be used as a base precursor. The former method is particularly effective. These hardly-soluble metal compound and complex-forming compound are preferably added to a light-sensitive element and a dye-fixing element separately.

A development stopping agent can be used in a light-sensitive element and/or a dye-fixing element according to the present invention for the purpose of obtaining constant images irrespective of the fluctuations in the processing temperature and the processing time at development time.

A development stopping agent herein means a compound which immediately neutralizes a base or reacts with a base to reduce the concentration of the base in a film to thereby stop development, or a compound which correlates with silver and silver salt to inhibit development. Specifically, an acid precursor which releases an acid by heating, an electrophilic compound which undergoes a substitution reaction with the coexisting base by heating, a nitrogen-containing heterocyclic compound, a mercapto compound or a precursor thereof. Details are disclosed on pp. 31 and 32 of JP-A-62-253159.

A support for a light-sensitive element and a dye-fixing element according to the present invention include, in general, paper and a synthetic high polymer (film). Specifically, polyethylene terephthalate, polycarbonate, polyvinyl chloride, polystyrene, polypropylene, polyimide, celluloses (e.g., triacetyl cellulose), or films of these compounds to which a pigment such as titanium oxide is incorporated, synthetic paper of a film such as polypropylene, mixed paper comprising synthetic resin pulp such as polyethylene and natural pulp, yankee paper, baryta paper, coated paper (in particular, cast coated paper), metal, cloth, glass, etc.

They can be used alone, or as a support one or both surfaces of which is laminated with a high polymer such as polyethylene.

Supports disclosed on pp. 29 to 31 of JP-A-62-253159 can also be used.

Surfaces of these supports may be coated with a hydrophilic binder and semi-conductive metal oxide such as alumina sol and stannic oxide, and antistatic agent such as carbon black or the like.

A light-sensitive element and/or a dye-fixing element may be the form having a conductive exothermic layer as a heating means for heat development or for the diffusion transfer of a dye by heating. As a transparent or opaque exothermic element in this case, those disclosed in JP-A-61-145544 can be used. Such a conductive layer also functions as an antistatic layer.

A diffusion transfer photographic material of the present invention may be processed by a so-called color diffusion transfer method in which image formation is conducted using an alkaline processing composition near room temperature, or may be heat development processed. With respect to a color diffusion transfer method, various known methods can be used.

Heat development processing is described below.

It is possible to conduct development at heating temperature in heat development step of from about 50° C. to about 250° C., but from about 80° C. to about 180° C. is particularly preferred. Diffusion transfer step of a dye may be carried out at the same time with heat development, or may be conducted after the termination of heat development step. In the latter case, it is possible to conduct transfer at heating temperature in transfer step of from the heat development temperature to room temperature, but is preferably 50° C. or more and lower than the temperature in heat development step by 10° C. or so.

Dye transfer occur only by heat but a solvent may be used to accelerate dye transfer. Further, as is disclosed in JP-A-59-218443 and JP-A-61-238056 in detail, a method of conducting development and transfer at the same time or successively by heating in the presence of a small amount of a solvent (in particular, water) is also useful. In this method, the heating temperature is preferably 50° C. or more and the boiling point or less of the solvent, e.g., when a solvent is water, the heating temperature is preferably from 50° C. to 100° C.

As examples of solvents which are used for the acceleration of development and/or the transfer of a diffusible dye to a dye-fixing layer, water and basic aqueous solution containing an inorganic alkali metal salt or an organic base (bases described in the item of image-forming accelerator can be used as such bases) can be cited. Further, a low boiling point solvent, or a mixed solution of a low boiling point solvent and water or basic aqueous solution can also be used. A surfactant, an antifoggant, a hardly soluble metal salt and a complex-forming compound may be added to a solvent.

These solvents may be used to a dye-fixing element or a light-sensitive element or both of them. The total use amount of the solvent should be sufficient in such a small amount as the weight of the solvent corresponding to the maximum swollen volume of the total coated film or less (in particular, the weight of the solvent corresponding to the maximum swollen volume of the total coated film minus the weight of the total coated film or less).

The method of giving a solvent to a light-sensitive layer or a dye-fixing layer is disclosed, for example, on p. 26 of JP-A-61-147244. A microcapsulated solvent can be previously incorporated into a light-sensitive element or a dye-fixing element or both of them.

A method of incorporating a hydrophilic thermal solvent, which is solid at room temperature and dissolved at high temperature, into a light-sensitive element or a dye-fixing element can also be used for accelerating dye transfer. A hydrophilic thermal solvent may be incorporated into either a light-sensitive element or a dye-fixing element, or may be incorporated into both of them. It may be incorporated into any layer of an emulsion layer, an interlayer, a protective layer, or a dye-fixing layer, but is preferably incorporated into a dye-fixing layer and/or adjacent layers thereto.

Examples of hydrophilic thermal solvents include ureas, pyridines, amides, sulfonamides, imides, alcohols, oximes and other heterocyclic rings.

Further, it is preferred for a light-sensitive element and/or a dye-fixing material to contain a high boiling point organic solvent for accelerating dye transfer.

Heating method in development and/or transfer step include bringing a material into contact with a heated block or plate, a hot plate, a hot presser, a hot roller, a halogen lamp heater, an infrared or far infrared lamp heater, or passing a material through atmosphere of high temperature.

Conditions of applying pressure when a light-sensitive element is superposed on a dye-fixing element and closely contacted and a method of applying pressure disclosed on p. 27 of JP-A-61-147244 can be applied to the present invention.

Any of various heat developing apparatus can be used for processing a photographic element according to the present invention. For example, apparatus disclosed in JP-A-59-75247, JP-A-59-177547, JP-A-59-181353, JP-A-60-18951 and JP-A-U-62-25944 (the term "JP-A-U" as used herein means an "unexamined published Japanese utility model application") are preferably used.

As a method of exposing and recording an image on a light-sensitive element, there are a method of directly photographing a landscape, a person, etc. using a camera, a method of exposure through a reversal film or a negative film using a printer or an enlarger, a method of scanning exposing an original picture through a slit using an exposing apparatus of a copying machine, a method of exposing an image information via an electric signal by emitting a light emitting diode or various kinds of lasers, and a method of outputting an image information on an image display unit such as a CRT, a liquid crystal display, an electroluminescence display, or a plasma display, and exposing directly or via an optical system.

As a light source for recording an image on a light-sensitive element, a natural light, a tungsten lamp, a light emitting diode, a laser light source, and a CRT light source can be used as described above and they are disclosed in column 56 of U.S. Pat. No. 4,500,626.

In addition, exposure can be carried out using a wavelength conversion element of a combination of a nonlinear optical material and a coherent light source such as a laser beam, etc. A nonlinear optical element means a substance capable of manifesting nonlinearity between polarization and electric field which appears when strong photoelectric field such as a laser beam is given. Compounds which are preferably used as such substances include inorganic compounds represented by lithium niobate, potassium dihydrogenphosphate (KDP), lithium iodate, and $BaB_2O_4$, urea derivatives, nitroaniline derivatives, nitropyridine-N-oxide derivatives, e.g., 3-methyl-4-nitropyridine-N-oxide (POM), and the compounds disclosed in JP-A-61-53462 and JP-A-62-210432. A monocrystal light guiding wave route type and a fiber type are known as the form of a wavelength conversion element and both of them are useful.

A video camera, an image signal obtained from an electron still camera, a television signal represented by Nippon Television Signal Code (NTSC), a picture signal obtained by dividing an original picture into many picture elements by a scanner, and an image signal formed using a computer represented by CG and CAD can be used for the above image information.

The present invention will be described in detail with reference to specific examples but the present invention should not be construed as being limited thereto.

EXAMPLE 1

Each layer having the following composition was multilayer-coated on an undercoated polyethylene terephthalate film support and a multilayer photographic material was prepared as Sample No. 100 to observe the oil transfer between layers.

The numeral corresponding to each component indicates the coated weight in unit of $g/m^2$, and the coated weight of silver halide is shown as the calculated weight of silver.

| Photographic Material Sample No. 100 | |
|---|---|
| First Layer: Oil Emulsified Layer | |
| Oil A | 2.00 |
| Gelatin | 2.00 |
| Surfactant A | 0.05 |

-continued

| Photographic Material Sample No. 100 | |
|---|---|
| Second Layer: Interlayer (diffusion controlling layer) | |
| Gelatin | 1.00 |
| Surfactant A | 0.02 |
| Third Layer: Emulsion Layer (coloring layer) | |
| Silver Iodobromide Emulsion | 2.50 as silver |
| Yellow Colored Magenta Coupler A | 1.00 |
| Gelatin | 1.50 |
| Surfactant A | 0.05 |
| Fourth Layer: Protective Layer | |
| Gelatin | 0.70 |
| Surfactant A | 0.10 |
| H-1 | 0.22 |

Oil A

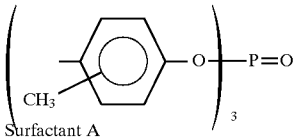

Surfactant A

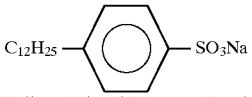

Yellow Colored Magenta Coupler

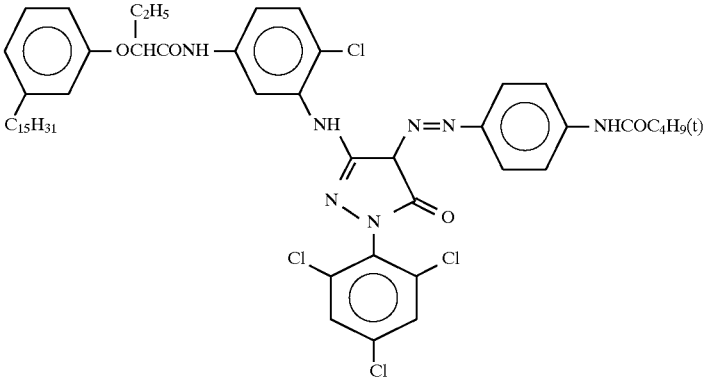

H-1

$CH_2{=}CHSO_2CH_2CONH(CH_2)_n\ NHCOCH_2SO_2CH{=}CH_2$

A 1/1 mixture of n = 2 and 3

Photographic material Sample Nos. 101 to 110 were prepared in the same manner as the preparation of Sample No. 100 except that swellable synthetic mica Somasif ME100 (a product of COOP Chemical Co.) was added to the second layer (an interlayer) as shown in Table 6 below.

Photographic material Sample Nos. 100 to 110 thus prepared were stored under the conditions of 80° C., 70% RH for two days, then sufficiently fogged by exposure to white light with fresh photographic materials and processed according to color negative standard development (CN-16).

In Sample Nos. 100 to 110, the coloring reaction of the yellow colored magenta coupler does not occur by development processing if the oil does not coexist in the same layer. When the oil penetrates the interlayer and diffuses to the emulsion layer by the preservation under high temperature and high humidity conditions, the yellow colored magenta coupler shows a coloring reaction by development processing and the color of the film changes from yellow to magenta. Therefore, the degree of the oil transfer between layers in the photographic material can be estimated by measuring the green light density.

Transmittance density of green light of each of Sample Nos. 100 to 110 was measured and the results obtained are shown in Table 6 below. The results with respect to Sample Nos. 100 to 107 are further shown in FIG. 1.

TABLE 6

| Sample No. | Somasif EM100 ($g/m^2$) | Gelatin ($g/m^2$) | Transmittance Density of Green Light |
|---|---|---|---|
| 100 | 0 | 1.5 | 1.15 |
| 101 | 0.01 | 0.2 | 1.21 |
| 102 | 0.02 | 0.2 | 1.2 |
| 103 | 0.025 | 0.2 | 0.9 |
| 104 | 0.05 | 0.2 | 0.55 |
| 105 | 0.1 | 0.2 | 0.53 |
| 106 | 0.15 | 0.2 | 0.52 |
| 107 | 0.2 | 0.2 | 0.55 |
| 108 | 0.05 | 0.4 | 0.55 |
| 109 | 0.05 | 0.8 | 0.65 |
| 110 | 0.05 | 1.2 | 0.78 |

As can be seen from the results in Table 6 and FIG. 1, the oil transfer between layers can be completely prevented by incorporating the inorganic stratifying compound to the interlayer in an amount of at least 0.05 $g/m^2$ or more.

EXAMPLE 2

Each layer having the following composition was multilayer-coated on an undercoated polyethylene terephthalate film support and a multilayer photographic material was prepared as Sample No. 200.

The numeral corresponding to each component indicates the coated weight in unit of g/m$^2$, and the coated weight of silver halide is shown as the calculated weight of silver.

| Photographic Material Sample No. 200 | |
|---|---|
| First Layer: Emulsion Layer (coloring layer) | |
| Silver Iodobromide Emulsion | 2.50 as silver |
| Yellow Colored Magenta Coupler A | 1.00 |
| Oil A | 2.00 |
| Gelatin | 2.00 |
| Surfactant A | 0.05 |
| Second Layer: Interlayer (diffusion controlling layer) | |
| Gelatin | 1.00 |
| Surfactant A | 0.02 |
| Third Layer: Protective Layer | |
| Gelatin | 0.70 |
| Surfactant A | 0.10 |
| H-1 | 0.15 |

Photographic material Sample No. 201 was prepared in the same manner as the preparation of Sample No. 200 except that the second layer (an interlayer) was replaced with the interlayer of Sample No. 105, which was one of the samples completely inhibited the oil diffusion between layers of dry film in Example 1.

Photographic material Sample Nos. 200 and 201 thus prepared were sufficiently fogged by exposure to white light, then processed by color negative development (CN-16) with changing the developing time to 1 minute and 45 seconds, 2 minutes and 15 seconds, 2 minutes and 45 seconds, 3 minutes and 15 seconds, and 3 minutes and 45 seconds, and the progress of development was observed.

From the observation of the progress of development of Sample Nos. 200 and 201, it can be seen whether the interlayer containing an organic stratifying compound inhibits the diffusion of processing solutions such as a developing agent at developing time.

The results of the measurement of transmittance density of green light of each of the above-processed photographic material Sample Nos. 200 and 201 are shown in Table 7 below.

TABLE 7

| Development Time (minutes) | Dmax No. 200 | Dmax No. 201 |
|---|---|---|
| 1.75 | 1.97 | 1.9 |
| 2.15 | 2.15 | 2.08 |
| 2.75 | 2.21 | 2.22 |
| 3.15 | 2.22 | 2.28 |
| 3.75 | 2.23 | 2.23 |

From the above results, it is understood that the interlayer containing the organic stratifying compound of the present invention slightly inhibits development at early stage of development but around developing time of 3 minutes and 45 seconds, which is standard developing time, development is rather accelerated than inhibited.

EXAMPLE 3

A light-sensitive element having the structure shown in Table E was prepared as Sample No. 301.

TABLE E

Structure of Light-Sensitive Element Sample No. 301

| Layer No. | Name of Layer | Additive | Coating Amount (mg/m$^2$) |
|---|---|---|---|
| 6th Layer | Protective layer | Gelatin | 900 |
| | | Silica (size: 4 μm) | 40 |
| | | Zinc hydroxide | 600 |
| | | Surfactant (2) | 130 |
| 5th Layer | Blue-sensitive emulsion layer | Blue-sensitive silver halide emulsion | 380 (as silver) |
| | | Yellow dye donative compound (1) | 400 |
| | | Gelatin | 600 |
| | | Electron donor (1) | 303 |
| | | High boiling point organic solvent (2) | 200 |
| | | Precursor of electron transferring agent (1) | 15 |
| | | Zinc hydroxide | 330 |
| | | Antifoggant (1) | 0.6 |
| 4th Layer | Interlayer | Gelatin | 700 |
| | | Electron donor (2) | 130 |
| | | High boiling point organic solvent (2) | 48 |
| | | Surfactant (3) | 61 |
| | | Electron transferring agent (1) | 27 |
| | | Electron transferring agent (2) | 36 |
| | | Hardening agent (1) | 37 |
| 3rd Layer | Green-sensitive emulsion layer | Green-sensitive silver halide emulsion | 220 (as silver) |
| | | Magenta dye donative compound (2) | 365 |
| | | Gelatin | 310 |
| | | Electron donor (1) | 158 |
| | | High boiling point organic solvent (2) | 183 |
| | | Electron transferring agent (1) | 27 |
| | | Precursor of electron transferring agent (1) | 15 |
| | | Antifoggant (3) | 0.3 |
| 2nd Layer | Interlayer | Gelatin | 400 |
| | | Zinc hydroxide | 300 |
| | | Electron donor (1) | 130 |
| | | High boiling point organic solvent (2) | 73 |
| | | Surfactant (3) | 100 |
| | | Activated carbon | 25 |
| 1st Layer | Red-sensitive emulsion layer | Red-sensitive silver halide emulsion | 230 (as silver) |
| | | Cyan dye donative compound (3) | 343 |
| | | Gelatin | 330 |
| | | Electron donor (1) | 163 |
| | | High boiling point organic solvent (2) | 172 |
| | | Electron transferring agent (1) | 28 |
| | | Precursor of electron transferring agent (1) | 17 |
| | | Antifoggant (4) | 0.7 |
| Support: Polyethylene terephthalate (96 μm) (carbon black was coated on the backing layer) | | | |

Surfactant (2)
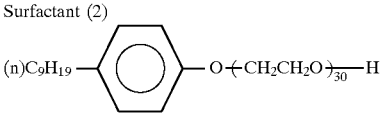
Antifoggant (2)
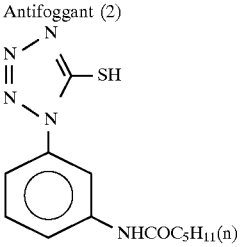
Electron Donor (1)
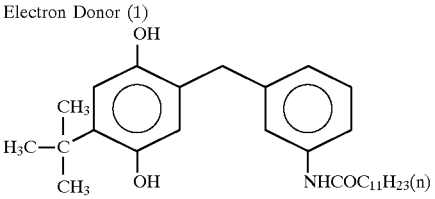
Precursor of Electron Transferring Agent (1)
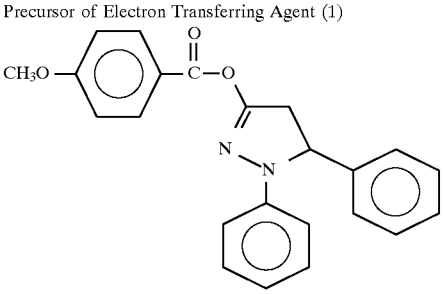
High Boiling Point Organic Solvent (2)
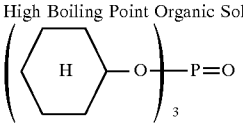
Surfactant (3)
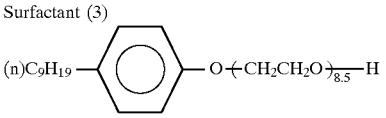
Electron Transferring Agent (1)
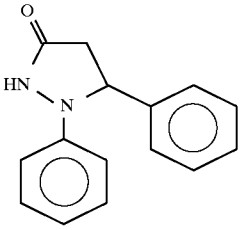
Electron Transferring Agent (2)
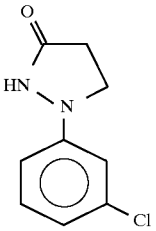

-continued
Hardening Agent (1)
$CH_2{=}CHSO_2CH_2CONH(CH_2)_2NHCOCH_2SO_2CH{=}CH_2$ (1)-1
$CH_2{=}CHSO_2CH_2CONH(CH_2)_3NHCOCH_2SO_2CH{=}CH_2$ (1)-2
A 3/1 mixture of (1)-1 and (1)-2
Antifoggant (3)
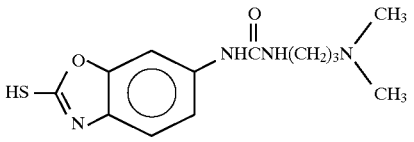
Antifoggant (4)
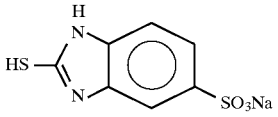
Yellow Dye Donative Compound (1)
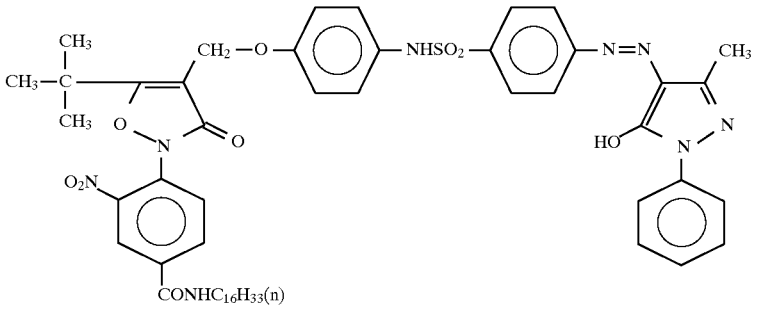
Magenta Dye Donative Compound (2)
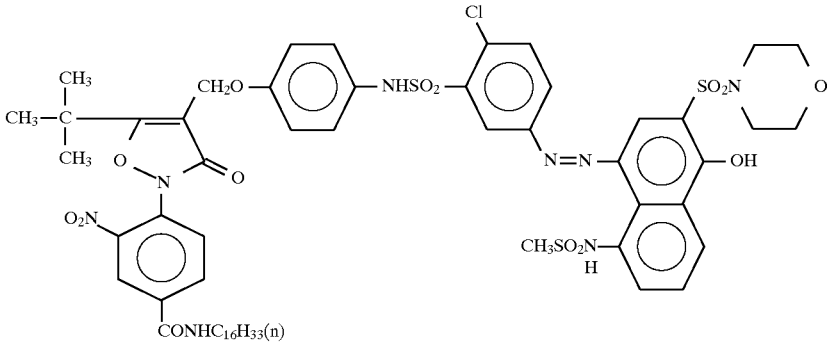
Cyan Dye Donative Compound (3)
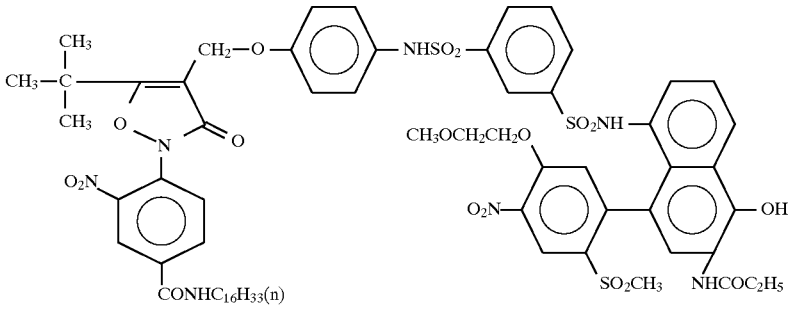
Electron Donor (2)

-continued

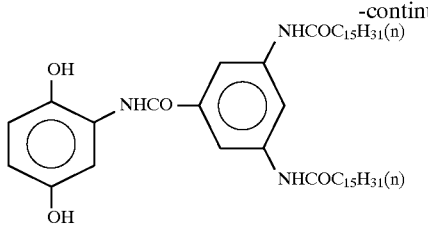

Light-sensitive element Sample No. 302 was prepared in the same manner as the preparation of Sample No. 301 except that 0.25 g/m$^2$ of gelatin and 0.12 g/m$^2$ of Somasif ME100 were used in place of 0.40 g/m$^2$ of gelatin in the second layer.

A dye-fixing element was prepared by coating the composition of the layer structure shown in the following Table F on a support having the structure shown in Table G and physical property values shown in Table H. The brightening agent (1) in the second layer was incorporated into the layer using high boiling organic solvent (1) in the same layer, ethyl acetate and sodium dodecylbenzenesulfonate by the oil protect method. This sample was designated dye-fixing element R300.

TABLE F

Layer Structure

| Layer No. | Additive | Coating Amount (g/m$^2$) |
|---|---|---|
| 4th Layer | Water-soluble polymer (1) | 0.25 |
| | Water-soluble polymer (2) | 0.07 |
| | Guanidine picolinate | 0.45 |
| | Surfactant (1) | 0.01 |
| | Surfactant (2) | 0.10 |
| | Surfactant (3) | 0.03 |
| 3rd Layer | Gelatin | 0.25 |
| | Water-soluble polymer (1) | 0.03 |
| | Surfactant (2) | 0.03 |
| | Hardening agent (1) | 0.16 |
| 2nd Layer | Gelatin | 1.40 |
| | Water-soluble polymer (1) | 0.20 |
| | Water-soluble polymer (3) | 0.60 |
| | Mordant (1) | 2.40 |
| | Guanidine picolinate | 2.20 |
| | Brightening agent (1) | 0.055 |
| | Antistaining agent (1) | 0.060 |
| | High boiling point organic solvent (1) | 1.40 |
| | Surfactant (4) | 0.025 |
| 1st Layer | Gelatin | 0.25 |
| | Water-soluble polymer (1) | 0.02 |
| | Surfactant (1) | 0.005 |
| | Surfactant (2) | 0.005 |
| | Hardening agent (1) | 0.16 |

TABLE G

Structure of Support (1)

| Name of Layer | Composition | Film Thickness (μm) |
|---|---|---|
| Surface undercoat layer | Gelatin | 0.1 |
| Surface PE layer (glossy) | Low density polyethylene (density: 0.923): 89.2 parts<br>Surface-treated titanium oxide: 10.0 parts<br>Ultramarine blue: 0.8 parts | 20.0 |
| Pulp layer | High quality paper (LBKP/NBKP = 1/1, density: 1.080) | 73.0 |
| Back PE layer (matt) | High density polyethylene (density: 0.960) | 18.0 |
| Back surface undercoat layer | Gelatin | 0.05 |
| | Colloidal silica | 0.05 |
| | Total | 111.2 |

TABLE H

Physical Property Value of Support (1)

| Item | Unit | Physical Property Value | | Measuring Method | | | |
|---|---|---|---|---|---|---|---|
| Stiffness (length/breadth) | g | 4.40/3.15 | | Taper stiffness meter | | | |
| Whiteness | | L* | 94.20 | CLE | L* | a* | b* |
| | | a* | +0.12 | | | | |
| | | b* | −2.75 | | | | |

Water-Soluble Polymer (1)

Sumikagel L5-H (a product of Sumitomo Chemical Co., Ltd.)

Water-Soluble Polymer (2)

K-carrageenan (a product of Taito Co., Ltd.)

Water-Soluble Polymer (3)

Dextran (molecular weight: 300,000)

Brightening Agent 2,5-Bis[5-t-benzoxazole(2)]thiophene

High Boiling Point Organic Solvent (1)

Empara 40 (a product of Ajinomoto Co.)

Surfactant (1)

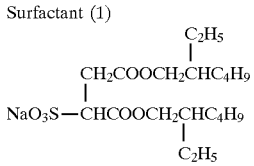

Surfactant (2)

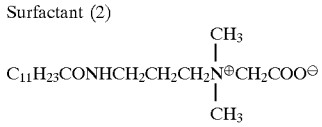

-continued

Surfactant (3)

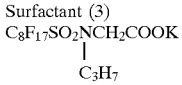

Surfactant (4)

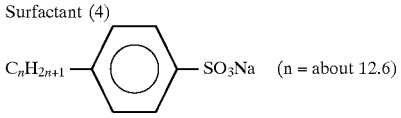

Hardener (1)

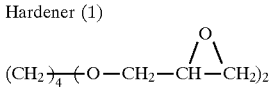

Mordant (1)

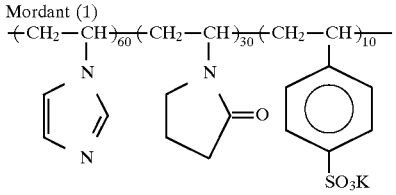

Antistaining Agent (1)

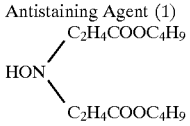

The thus-prepared light-sensitive element Sample Nos. 301 and 302 and dye-fixing element Sample No. R300 were processed using an imaging apparatus disclosed in JP-A-2-84634. That is, an original picture (a test chart on which yellow, magenta and cyan wedges having density continuously changed were recorded) was scanning exposed through a slit, each of these samples was immersed in water maintained at 40° C. for 5 seconds, squeezed with a roller, immediately superposed on the dye-fixing element so that film surfaces were contacted, and heated for 15 seconds with a heat roller which was adjusted to heat the water-absorbed film surface at 83° C. Subsequently, the dye-fixing element was peeled-off, to thereby obtain a color image on the dye-fixing element corresponding to the original.

The cyan image obtained using light-sensitive element Sample No. 301 was mixed with magenta, and the magenta image was mixed with cyan. In particular, the color mixture of the former was large. On the contrary, light-sensitive element Sample No. 302 of the present invention showed little color mixture in spite of a smaller coating amount of gelatin.

EXAMPLE 4

Each layer having the following composition was multilayer coated on an undercoated cellulose triacetate film support and a multilayer color photographic material was prepared as Sample No. 401.

Composition of Light-Sensitive Layer

The main components for use in each layer are classified as follows:

ExC: Cyan Coupler

ExM: Magenta Coupler

ExY: Yellow Coupler

ExS: Sensitizing Dye

UV: Ultraviolet Absorber

HBS: High Boiling Point Organic Solvent

H: Hardening Agent for Gelatin

The numeral corresponding to each component indicates the coated weight in unit of g/m$^2$, and the coated weight of silver halide is shown as the calculated weight of silver. Further, in the case of a sensitizing dye, the coated weight is indicated in unit of mol per mol of silver halide in the same layer.

| Sample No. 401. | |
|---|---|
| First Layer: Antihalation Layer | |
| Black Colloidal Silver | 0.18 as silver |
| Gelatin | 1.60 |
| ExM-1 | 0.12 |
| ExF-1 | $2.0 \times 10^{-3}$ |
| HBS-1 | 0.15 |
| HBS-2 | 0.02 |
| Second Layer: Interlayer | |
| Silver Iodobromide Emulsion M | 0.065 as silver |
| ExC-2 | 0.04 |
| Polyethyl Acrylate Latex | 0.20 |
| Gelatin | 1.04 |
| Third Layer: Low Sensitivity Red-Sensitive Emulsion Layer | |
| Silver Iodobromide Emulsion A | 0.25 as silver |
| Silver Iodobromide Emulsion B | 0.25 as silver |
| ExS-1 | $6.9 \times 10^{-5}$ |
| ExS-2 | $1.8 \times 10^{-5}$ |
| ExS-3 | $3.1 \times 10^{-4}$ |
| ExC-1 | 0.17 |
| ExC-3 | 0.030 |
| ExC-4 | 0.10 |
| ExC-5 | 0.020 |
| ExC-6 | 0.010 |
| Cpd-2 | 0.025 |
| HBS-1 | 0.10 |
| Gelatin | 0.87 |
| Fourth Layer: Middle Sensitivity Red-Sensitive Emulsion Layer | |
| Silver Iodobromide Emulsion C | 0.70 as silver |
| ExS-1 | $3.5 \times 10^{-4}$ |
| ExS-2 | $1.6 \times 10^{-5}$ |
| ExS-3 | $5.1 \times 10^{-4}$ |
| ExC-1 | 0.13 |
| ExC-2 | 0.060 |
| ExC-3 | 0.0070 |
| ExC-4 | 0.090 |
| ExC-5 | 0.015 |
| ExC-6 | 0.0070 |
| Cpd-2 | 0.023 |
| HBS-1 | 0.10 |
| Gelatin | 0.75 |
| Fifth Layer: High Sensitivity Red-Sensitive Emulsion Layer | |
| Silver Iodobromide Emulsion D | 1.40 as silver |
| ExS-1 | $2.4 \times 10^{-4}$ |
| ExS-2 | $1.0 \times 10^{-4}$ |
| ExS-3 | $3.4 \times 10^{-4}$ |
| ExC-1 | 0.10 |
| ExC-3 | 0.045 |
| ExC-6 | 0.020 |
| ExC-7 | 0.010 |
| Cpd-2 | 0.050 |
| HBS-1 | 0.22 |
| HBS-2 | 0.050 |
| Gelatin | 1.10 |
| Sixth Layer: Interlayer | |
| Cpd-1 | 0.090 |
| HBS-1 | 0.050 |
| Polyethyl Acrylate Latex | 0.15 |
| Gelatin | 1.10 |
| Seventh Layer: Low Sensitivity Green-Sensitive Emulsion Layer | |
| Silver Iodobromide Emulsion E | 0.15 as silver |
| Silver Iodobromide Emulsion F | 0.10 as silver |
| Silver Iodobromide Emulsion G | 0.10 as silver |
| ExS-4 | $3.0 \times 10^{-5}$ |

-continued

| Sample No. 401. | |
|---|---|
| ExS-5 | $2.1 \times 10^{-4}$ |
| ExS-6 | $8.0 \times 10^{-4}$ |
| ExM-2 | 0.33 |
| ExM-3 | 0.086 |
| ExY-1 | 0.015 |
| HBS-1 | 0.30 |
| HBS-3 | 0.010 |
| Gelatin | 0.73 |
| Eighth Layer: Middle Sensitivity Green-Sensitive Emulsion Layer | |
| Silver Iodobromide Emulsion H | 0.80 as silver |
| ExS-4 | $3.2 \times 10^{-5}$ |
| ExS-5 | $2.2 \times 10^{-4}$ |
| ExS-6 | $8.4 \times 10^{-4}$ |
| ExC-8 | 0.010 |
| ExM-2 | 0.10 |
| ExM-3 | 0.025 |
| ExY-1 | 0.018 |
| ExY-4 | 0.010 |
| ExY-5 | 0.040 |
| HBS-1 | 0.13 |
| HBS-3 | $4.0 \times 10^{-3}$ |
| Gelatin | 0.80 |
| Ninth Layer: High Sensitivity Green-Sensitive Emulsion Layer | |
| Silver Iodobromide Emulsion I | 1.25 as silver |
| ExS-4 | $3.7 \times 10^{-5}$ |
| ExS-5 | $8.1 \times 10^{-5}$ |
| ExS-6 | $3.2 \times 10^{-4}$ |
| ExC-1 | 0.010 |
| ExM-1 | 0.020 |
| ExM-4 | 0.025 |
| ExM-5 | 0.040 |
| Cpd-3 | 0.040 |
| HBS-1 | 0.25 |
| Polyethyl Acrylate Latex | 0.15 |
| Gelatin | 1.33 |
| Tenth Layer: Yellow Filter Layer | |
| Yellow Colloidal Silver | 0.030 as silver |
| Cpd-1 | 0.16 |
| HBS-1 | 0.60 |
| Gelatin | 0.60 |
| Eleventh Layer: Low Sensitivity Blue-Sensitive Emulsion Layer | |
| Silver Iodobromide Emulsion J | 0.09 as silver |
| Silver Iodobromide Emulsion K | 0.09 as silver |

-continued

| Sample No. 401. | |
|---|---|
| ExS-7 | $8.6 \times 10^{-4}$ |
| ExC-8 | $7.0 \times 10^{-3}$ |
| ExY-1 | 0.050 |
| ExY-2 | 0.22 |
| ExY-3 | 0.50 |
| ExY-4 | 0.020 |
| Cpd-2 | 0.10 |
| Cpd-3 | $4.0 \times 10^{-3}$ |
| HBS-1 | 0.28 |
| Gelatin | 1.20 |
| Twelfth Layer: High Sensitivity Blue-Sensitive Emulsion Layer | |
| Silver Iodobromide Emulsion L | 1.00 as silver |
| ExS-7 | $4.0 \times 10^{-4}$ |
| ExY-2 | 0.10 |
| ExY-3 | 0.10 |
| ExY-4 | 0.010 |
| Cpd-2 | 0.10 |
| Cpd-3 | $1.0 \times 10^{-3}$ |
| HBS-1 | 0.070 |
| Gelatin | 0.70 |
| Thirteenth Layer: First Protective Layer | |
| UV-1 | 0.19 |
| UV-2 | 0.075 |
| UV-3 | 0.065 |
| HBS-1 | $5.0 \times 10^{-2}$ |
| HBS-4 | $5.0 \times 10^{-2}$ |
| Gelatin | 1.8 |
| Fourteenth Layer: Second Protective Layer | |
| Silver Iodobromide Emulsion M | 0.10 as silver |
| H-1 | 0.40 |
| B-1 (diameter: 1.7 μm) | $5.0 \times 10^{-2}$ |
| B-2 (diameter: 1.7 μm) | 0.15 |
| B-3 | 0.05 |
| S-1 | 0.20 |
| Gelatin | 0.70 |

Further, W-1 to W-3, B-4 to B-6, F-1 to F-17, iron salt, lead salt, gold salt, platinum salt, palladium salt, iridium salt and rhodium salt were appropriately included in each layer to improve storage stability, processing properties, pressure resistance, fungicidal and biocidal properties, antistatic properties and coating properties.

TABLE J

| Emulsion | Average AgI Content (%) | Variation Coefficient of the AgI Content among Grains (%) | Average Diameter Corresponding to Sphere (μm) | Variation Coefficient of the Grain Size (%) | Projected Area Diameter Corresponding to Circle (μm) | Diameter/ Thickness Ratio |
|---|---|---|---|---|---|---|
| A | 1.7 | 10 | 0.46 | 15 | 0.56 | 5.5 |
| B | 3.5 | 15 | 0.57 | 20 | 0.78 | 4.0 |
| C | 8.9 | 25 | 0.66 | 25 | 0.87 | 5.8 |
| D | 8.9 | 18 | 0.84 | 26 | 1.03 | 3.7 |
| E | 1.7 | 10 | 0.46 | 15 | 0.56 | 5.5 |
| F | 3.5 | 15 | 0.57 | 20 | 0.78 | 4.0 |
| G | 8.8 | 25 | 0.61 | 23 | 0.77 | 4.4 |
| H | 8.8 | 25 | 0.61 | 23 | 0.77 | 4.4 |
| I | 8.9 | 18 | 0.84 | 26 | 1.03 | 3.7 |
| J | 1.7 | 10 | 0.46 | 15 | 0.50 | 4.2 |
| K | 8.8 | 18 | 0.64 | 23 | 0.85 | 5.2 |
| L | 14.0 | 25 | 1.28 | 26 | 1.46 | 3.5 |
| M | 1.0 | — | 0.07 | 15 | — | 1 |

In Table J:

(1) Emulsions J, K and L were reduction sensitized during preparation of the grains using thiourea dioxide and thiosulfonic acid according to the examples of JP-A-2-191938.

(2) Emulsions A to I were gold, sulfur, and selenium sensitized, respectively, in the presence of the spectral sensitizing dyes which are described at each light-sensitive layer and sodium thiocyanate according to the examples of JP-A-3-237450.

(3) Low molecular weight gelatin was used in the preparation of the tabular grains according to the examples of JP-A-1-158426.

(4) In tabular grains, there were observed such dislocation lines as disclosed in JP-A-3-237450 using a high pressure electron microscope.

(5) Emulsion L comprised double structure grains containing an internal high iodide core as disclosed in JP-A-60-143331.

ExC-1

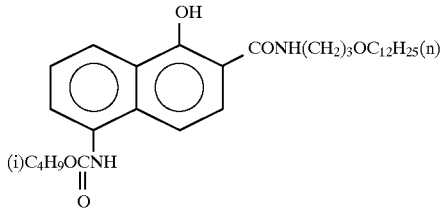

ExC-2

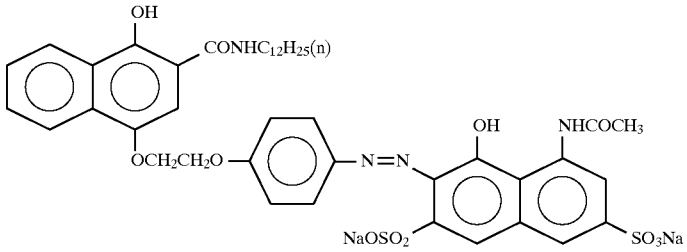

ExC-3

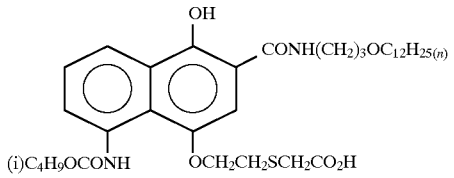

ExC-4

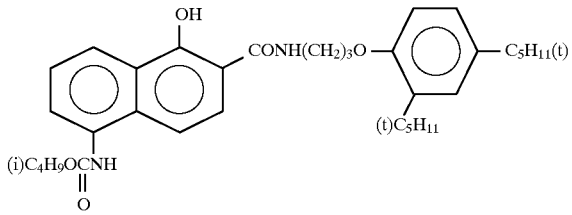

ExC-5

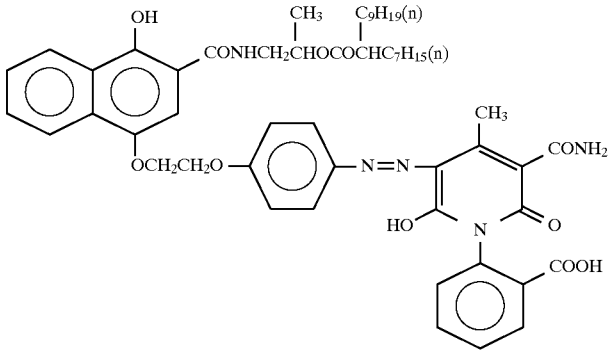

-continued
ExC-6
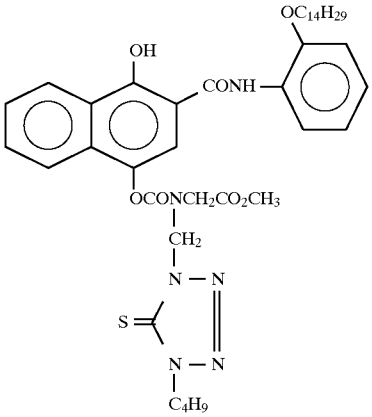
ExC-7
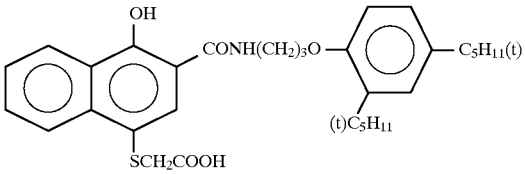
ExC-8
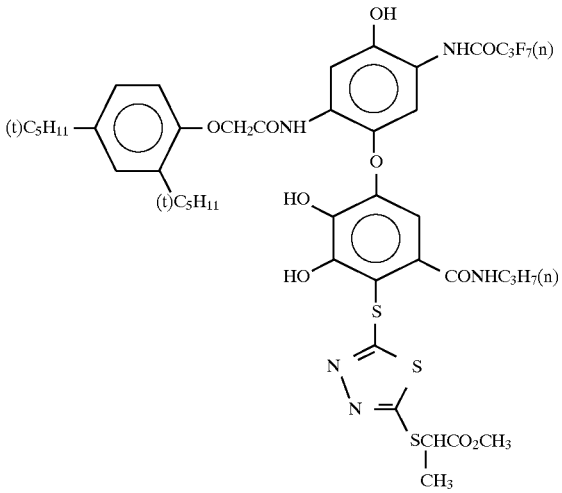
ExM-1
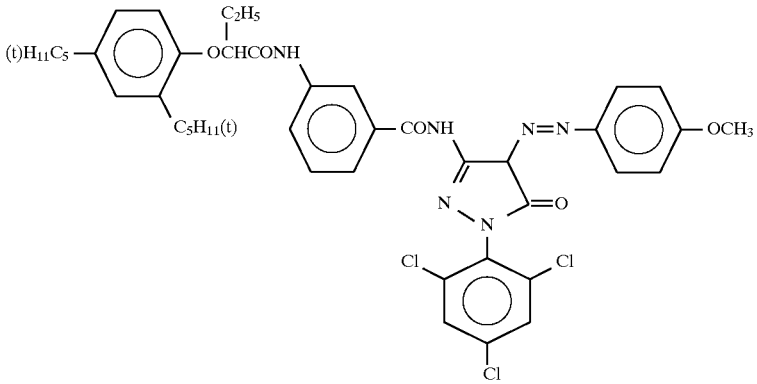

-continued
ExM-2
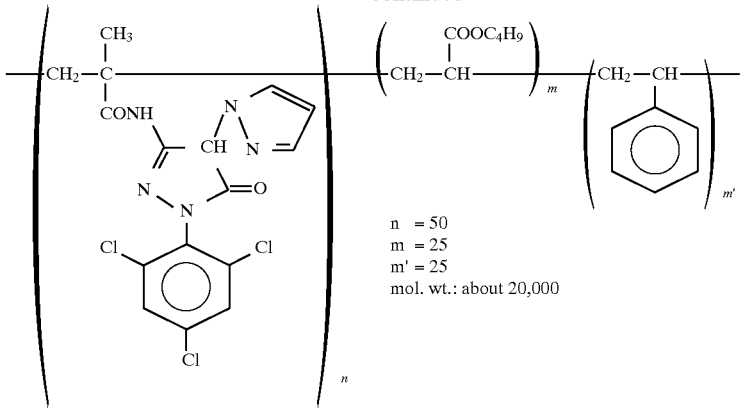
ExM-3
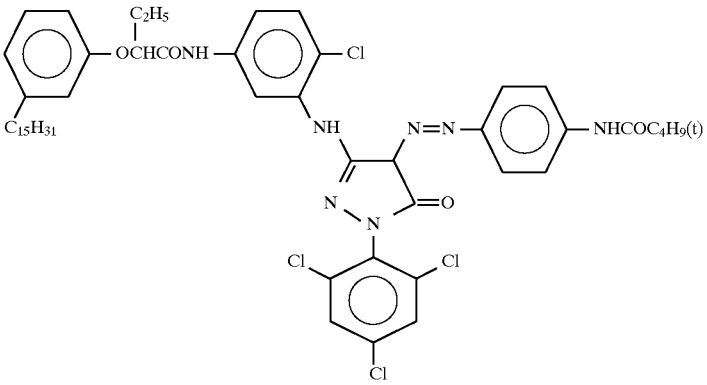
ExM-4
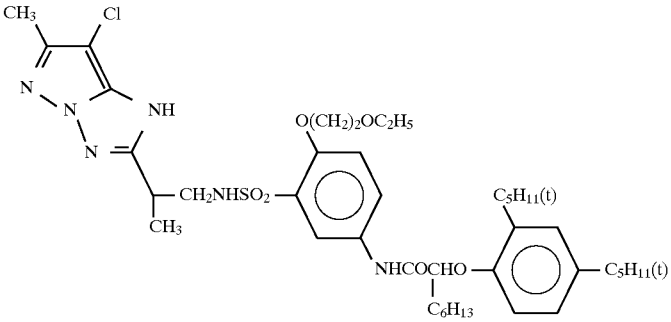
ExM-5
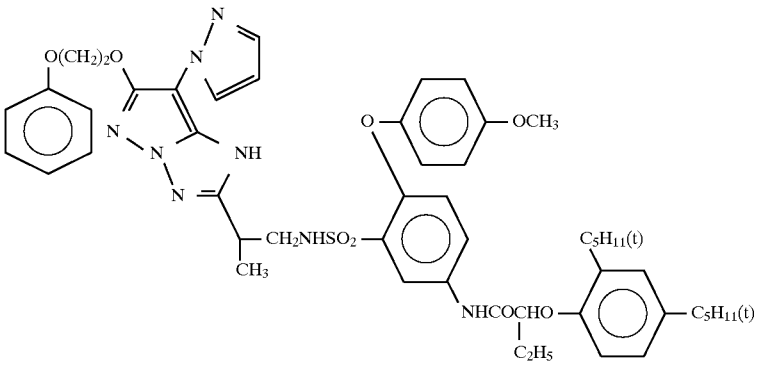

-continued
ExY-1
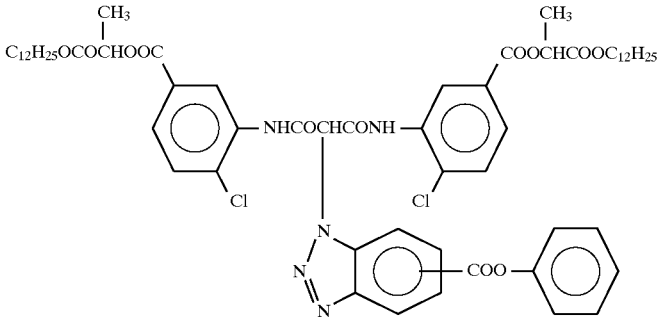
ExY-2
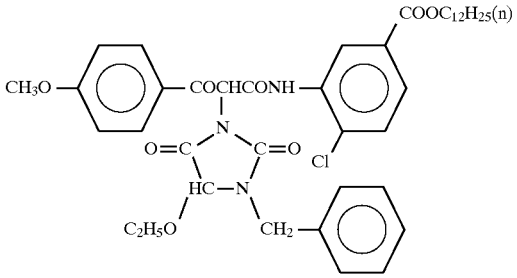
ExY-3
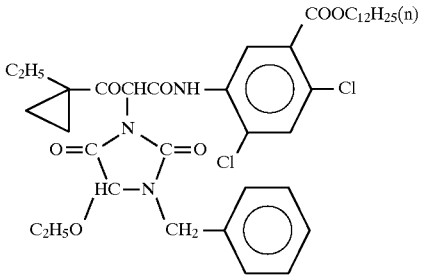
ExY-4
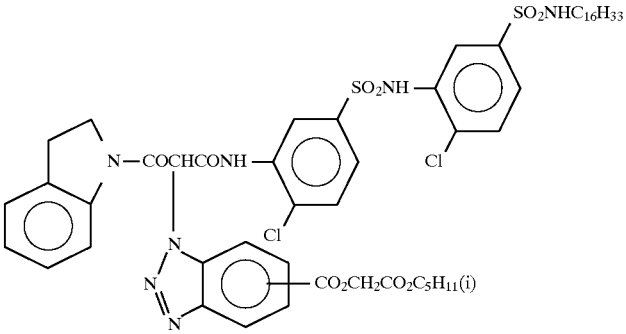
ExY-5
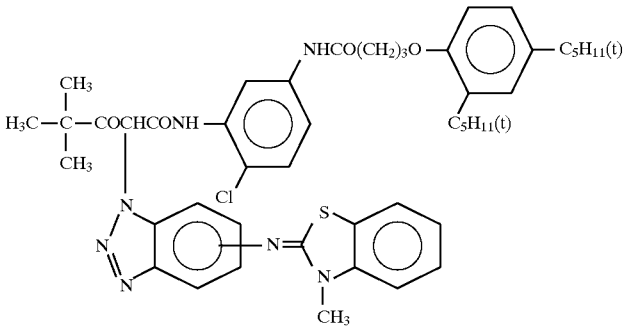

-continued
ExF-1
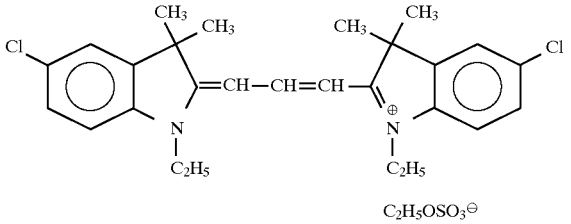
Cpd-1
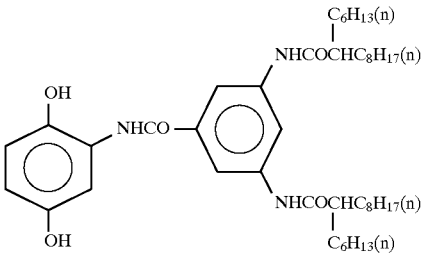
Cpd-2
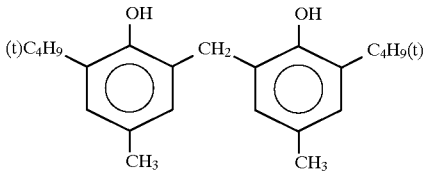
Cpd-3
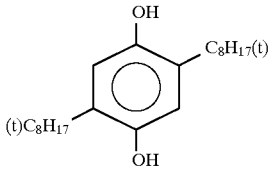
UV-1
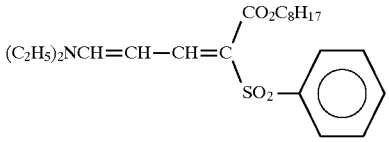
UV-2
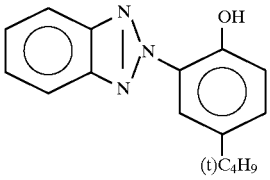
UV-3
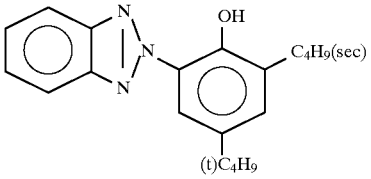
Tricresyl Phosphate HBS-1
Di-n-butyl Phthalate HBS-2
HBS-3
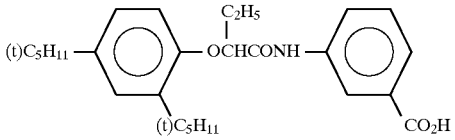
Tri(2-ethylhexyl) Phosphate HBS-4

-continued
ExS-1
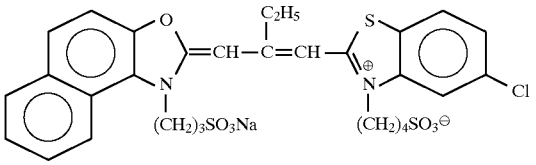
ExS-2
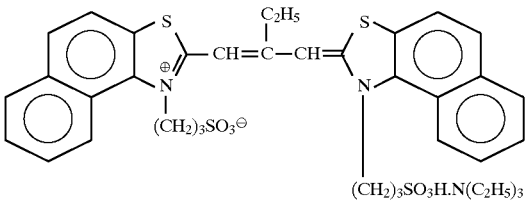
ExS-3
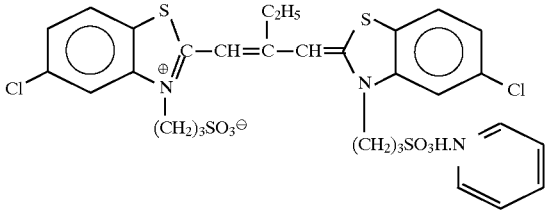
ExS-4
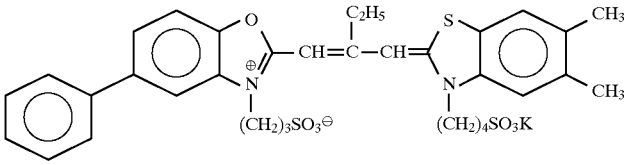
ExS-5
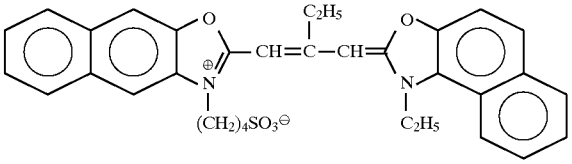
ExS-6
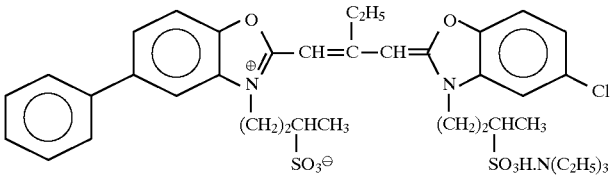
ExS-7
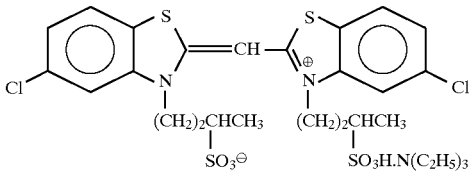
S-1
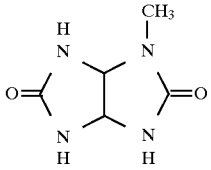
H-1
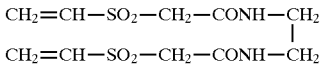

-continued
B-1
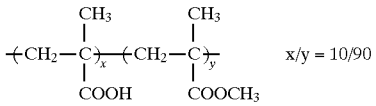
B-2
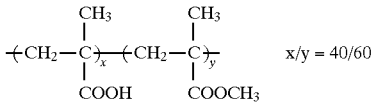
B-3
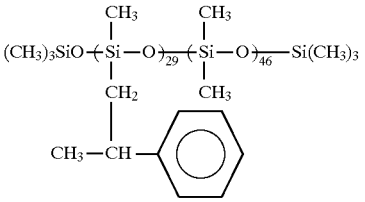
B-4
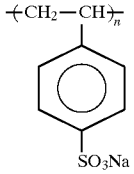
B-5
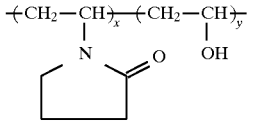
B-6
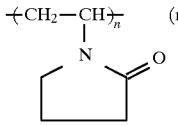
W-1
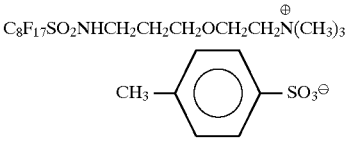
W-2
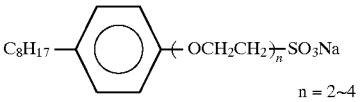
W-3
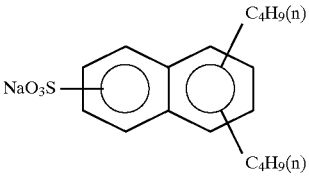
F-1
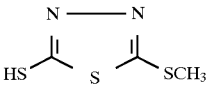

-continued
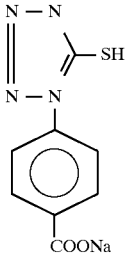
F-2
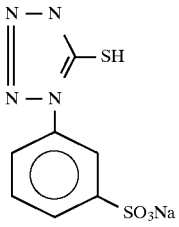
F-3
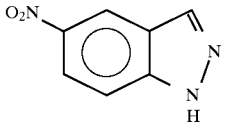
F-4
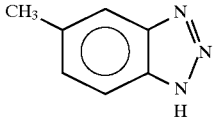
F-5
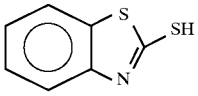
F-6
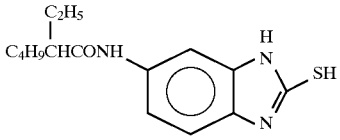
F-7
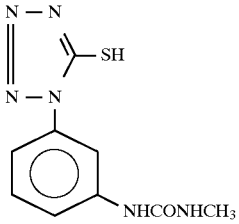
F-8
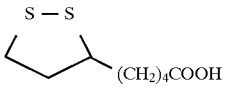
F-9
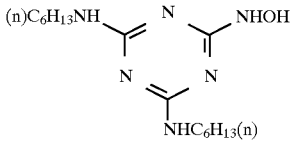
F-10
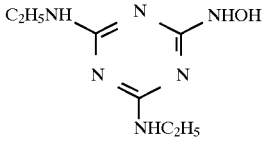
F-11

-continued

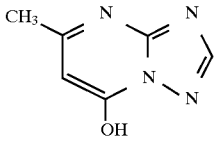

F-12

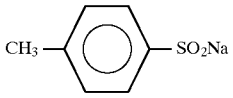

F-13

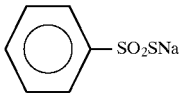

F-14

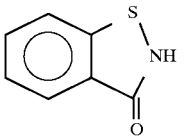

F-15

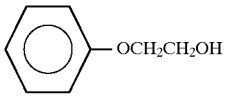

F-16

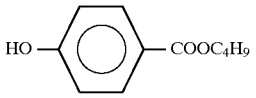

F-17

Photographic material Sample Nos. 402 and 403 were prepared by changing the sixth layer (an interlayer) in Sample No. 401 as follows.

| | |
|---|---|
| Sample No. 402: | |
| Gelatin | 0.25 |
| Polyethyl Acrylate Latex | 0.15 |
| Sample No. 403: | |
| Gelatin | 0.25 |
| Somasif ME100 | 0.12 |

Photographic material Sample Nos. 401 to 403 thus prepared were stored under the conditions of 50° C., 80% RH for one week, then processed according to color negative standard development (CN-16) with fresh photographic materials. Fog density of each sample (in particular, a green-sensitive layer and a blue-sensitive layer) was measured. Further, exposure and development processing were conducted using the above photographic material Sample Nos. 401 to 403 and color photographic paper produced by Fuji Photo Film Co., Ltd.

As a result, the part to be colored cyan was color mixed with magenta and the part to be colored magenta was color mixed with cyan in photographic materials stored under wet condition of Sample No. 401 and both fresh photographic materials and photographic materials stored under wet condition of Sample No. 402. On the contrary, neither fresh materials nor wet preserved materials of Sample No. 403 of the present invention generated color mixing.

EXAMPLE 5

The surface of a paper support laminated on both sides with polyethylene was corona discharged. The support was provided with an undercoat layer of gelatin containing sodium dodecylbenzenesulfonate and, further, the various photographic constitutional layers were multilayer-coated and a multilayer color photographic paper Sample No. 500 having the following layer structure was prepared.

Preparation of Sample No. 500

A multilayer color photographic paper Sample No. 500 having the following layer structure was prepared by coating various photographic constitutional layers on the above reflective support. The coating solution was prepared as follows.

Preparation of First Layer Coating Solution

One hundred and twenty-two point zero (122.0) grams of a yellow coupler (ExY), 15.4 g of a dye image stabilizer (Cpd-1), 7.5 g of a dye image stabilizer (Cpd-2), 16.7 g of a dye image stabilizer (Cpd-3) were dissolved in 44 g of a solvent (Solv-1) and 180 ml of ethyl acetate, and this solution was mixed to 1,000 g of a 10% aqueous gelatin solution containing 86 ml of 10% sodium dodecylbenzenesulfonate and dispersed in an emulsified condition to obtain Emulsified Dispersion A. On the other hand, two kinds of silver chlorobromide Emulsions A were prepared (cubic form, a mixture in a ratio of 3/7 (silver mol ratio) of a large grain size Emulsion A having an average grain size of 0.88 μm, and a small grain size Emulsion A having an average grain size of 0.70 μm; variation coefficients of the grain size distribution were 0.08 and 0.10, respectively, both of them contained 0.3 mol % of silver bromide localized at a part of the grain surface, and the remaining substrate being comprising silver chloride). The blue-sensitive Sensitizing Dyes A, B, and C shown below were added respectively in an amount of $8.0\times10^{-5}$ mol per mol of silver to the large grain size Emulsion A, and $1.0\times10^{-4}$ mol per mol of silver to the small grain size Emulsion A. Chemical ripening was conducted by the addition of a sulfur sensitizer and a gold sensitizer. The foregoing Emulsified Dispersion A was mixed with this silver chlorobromide Emulsion A and dissolved to obtain a coating solution for the first layer having the composition described below. The coating amount of the emulsion was calculated in terms of silver.

The coating solutions for from the second to seventh layers were prepared in the same manner as the coating solution for the first layer. 1-Oxy-3,5-dichloro-s-triazine sodium salt was used as a gelatin hardening agent in each layer.

Blue-Sensitive Emulsion Layer:

Spectral Sensitizing Dye A

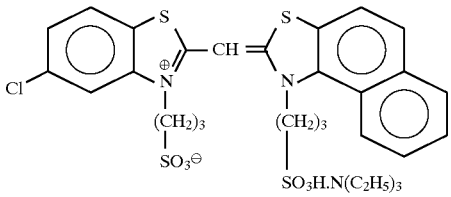

Spectral Sensitizing Dye B

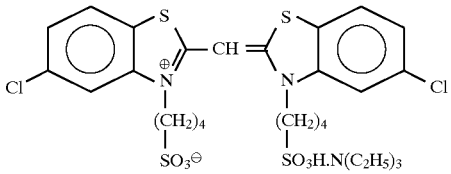

Spectral Sensitizing Dye C

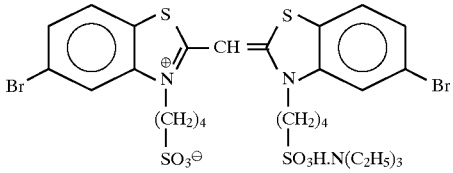

(each in an amount of $1.4 \times 10^{-4}$ mol/mol Ag to the large grain size emulsion, and each in an amount of $1.7 \times 10^{-4}$ mol/mol Ag to the small grain size emulsion)

Green-Sensitive Emulsion Layer:

Spectral Sensitizing Dye D

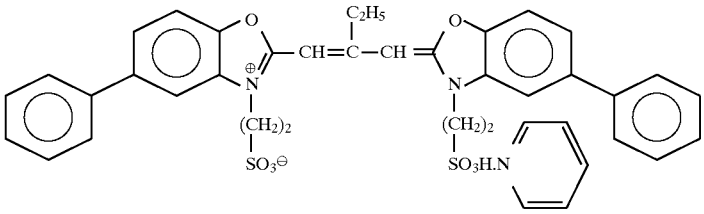

(in an amount of $3.0 \times 10^{-4}$ mol/mol Ag to the large grain size emulsion, and $3.6 \times 10^{-4}$ mol/mol Ag to the small grain size emulsion)

Spectral Sensitizing Dye E

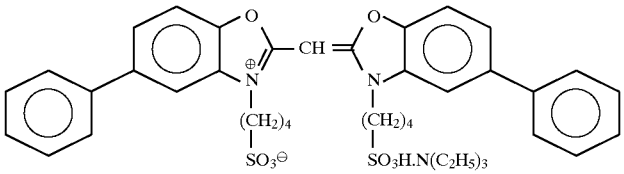

(in an amount of $4.0 \times 10^{-4}$ mol/mol Ag to the large grain size emulsion, and $7.0 \times 10^{-4}$ mol/mol Ag to the small grain size emulsion)

Spectral Sensitizing Dye F

-continued

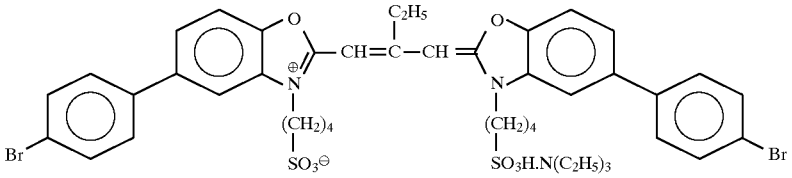

(in an amount of $2.0 \times 10^{-4}$ mol/mol Ag to the large grain size emulsion, and $2.8 \times 10^{-4}$ mol/mol Ag to the small grain size emulsion)

Red-Sensitive Emulsion Layer:

Spectral Sensitizing Dye G

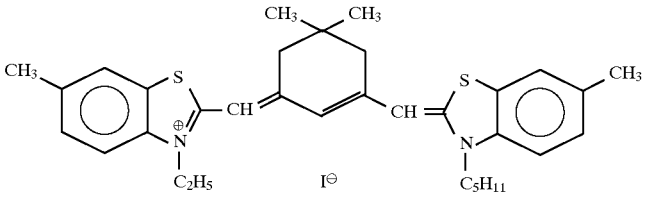

(in an amount of $5.0 \times 10^{-4}$ mol/mol Ag to the large grain size emulsion, and in an amount of $8.0 \times 10^{-4}$ mol/mol Ag to the small grain size emulsion)

Spectral Sensitizing Dye H

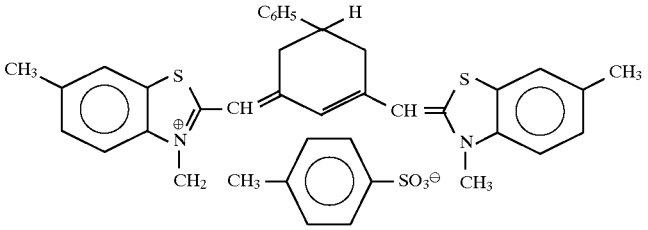

(in an amount of $5.0 \times 10^{-4}$ mol/mol Ag to the large grain size emulsion, and in an amount of $8.0 \times 10^{-4}$ mol/mol Ag to the small grain size emulsion)

The following compound was further added to the red-sensitive emulsion layer in an amount of $2.0 \times 10^{-4}$ mol per mol of silver halide.

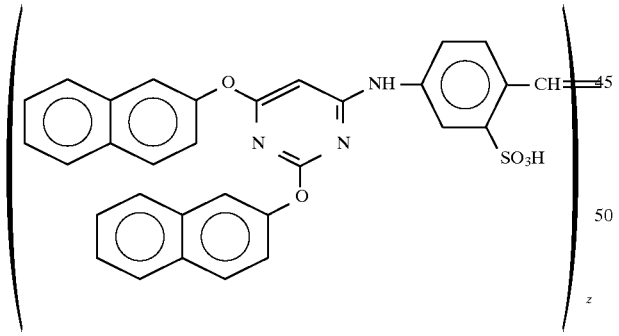

Further, 1-(5-methylureidophenyl)-5-mercaptotetrazole was added to the blue-sensitive emulsion layer, the green-sensitive emulsion layer and the red-sensitive emulsion layer in an amount of $3.3 \times 10^{-4}$ mol, $1.0 \times 10^{-3}$ mol and $5.9 \times 10^{-4}$ mol, respectively, per mol of silver halide.

Further, 1-(5-methylureidophenyl)-5-mercaptotetrazole was added to the second layer, the fourth layer, the sixth layer, and the seventh layer so that the coating amount becomes 0.2 mg/m$^2$, 0.2 mg/m$^2$, 0.6 mg/m$^2$, and 0.1 mg/m$^2$, respectively.

In addition, 4-hydroxy-6-methyl-1,3,3a,7-tetraazaindene was added to the blue-sensitive emulsion layer and the green-sensitive emulsion layer in an amount of $1 \times 10^{-4}$ mol and $2 \times 10^{-4}$ mol, respectively, per mol of silver halide.

Moreover, the following dyes were added to the sixth layer as an irradiation preventing water-soluble dye.

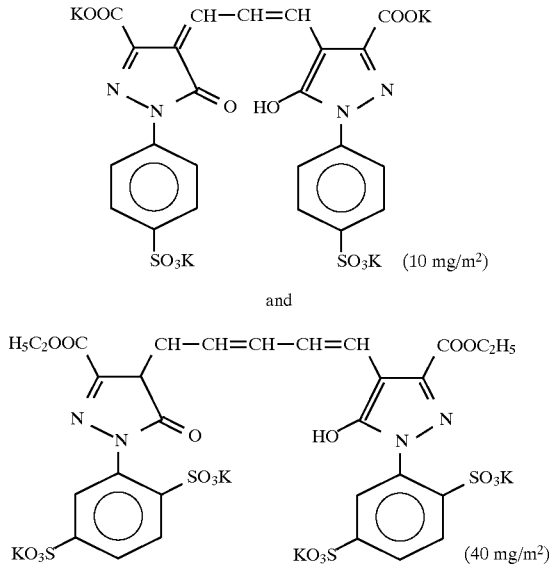

Layer Structure

The composition of each layer is described below. The numeral represents the coating amount (g/m$^2$). The numeral for the silver halide emulsion represents the coating amount in terms of silver.

Support

Polyethylene-laminated paper (a white pigment ($TiO_2$) and a blue dye (ultramarine) were added to the polyethylene of the first layer side).

| First Layer (blue-sensitive emulsion layer) | |
|---|---|
| Silver Chlorobromide Emulsion A described above | 0.25 as silver |
| Gelatin | 1.38 |
| Yellow Coupler (ExY) | 0.60 |
| Dye Image Stabilizer (Cpd-1) | 0.08 |
| Dye Image Stabilizer (Cpd-2) | 0.04 |
| Dye Image Stabilizer (Cpd-3) | 0.08 |
| Dye Image Stabilizer (Cpd-5) | 0.02 |
| Solvent (Solv-1) | 0.22 |
| **Second Layer (color mixture preventing layer)** | |
| Gelatin | 1.01 |
| Color Mixing Preventive (Cpd-4) | 0.13 |
| Solvent (Solv-1) | 0.07 |
| Solvent (Solv-2) | 0.20 |
| Solvent (Solv-3) | 0.15 |
| Solvent (Solv-7) | 0.12 |
| Dye Image Stabilizer (Cpd-7) | 0.10 |
| **Third Layer (green-sensitive emulsion layer)** | |
| Silver Chlorobromide Emulsion (cubic form, a mixture in a ratio of 1/3 (Ag mol ratio) of a large grain size Emulsion B having an average grain size of 0.55 μm, and a small grain size Emulsion B having an average grain size of 0.39 μm; variation coefficients of the grain size distribution are 0.10 and 0.08, respectively, both of them contained 0.8 mol % of silver bromide localized at a part of the grain surface of substrate of silver chloride) | 0.13 as silver |
| Gelatin | 1.45 |
| Magenta Coupler (ExM) | 0.13 |
| UV Absorber (UV-A) | 0.12 |
| Dye Image Stabilizer (Cpd-2) | 0.01 |
| Dye Image Stabilizer (Cpd-5) | 0.02 |
| Dye Image Stabilizer (Cpd-6) | 0.01 |
| Dye Image Stabilizer (Cpd-7) | 0.08 |
| Dye Image Stabilizer (Cpd-8) | 0.03 |
| Dye Image Stabilizer (Cpd-9) | 0.01 |
| Solvent (Solv-4) | 0.22 |
| Solvent (Solv-5) | 0.11 |
| Solvent (Solv-8) | 0.15 |

-continued

| Fourth Layer (color mixture preventing layer) | |
|---|---|
| Gelatin | 0.73 |
| Color Mixing Preventive (Cpd-4) | 0.10 |
| Solvent (Solv-1) | 0.05 |
| Solvent (Solv-2) | 0.15 |
| Solvent (Solv-3) | 0.12 |
| Solvent (Solv-7) | 0.09 |
| Dye Image Stabilizer (Cpd-7) | 0.07 |
| **Fifth Layer (red-sensitive emulsion layer)** | |
| Silver Chlorobromide Emulsion (cubic form, a mixture in a ratio of 1/4 (Ag mol ratio) of a large grain size Emulsion having an average grain size of 0.50 μm, and a small grain size Emulsion having an average grain size of 0.41 μm; variation coefficients of the grain size distribution are 0.09 and 0.11, respectively, both of them contained 0.8 mol % of silver bromide localized at a part of the grain surface of substrate of silver chloride) | 0.19 as silver |
| Gelatin | 0.74 |
| Cyan Coupler (ExC) | 0.24 |
| UV Absorber (UV-B) | 0.21 |
| Dye Image Stabilizer (Cpd-1) | 0.20 |
| Dye Image Stabilizer (Cpd-6) | 0.01 |
| Dye Image Stabilizer (Cpd-8) | 0.01 |
| Dye Image Stabilizer (Cpd-9) | 0.01 |
| Dye Image Stabilizer (Cpd-10) | 0.01 |
| Solvent (Solv-1) | 0.01 |
| Solvent (Solv-6) | 0.20 |
| **Sixth Layer (UV absorbing layer)** | |
| Gelatin | 0.73 |
| UV Absorber (UV-C) | 0.34 |
| Dye Image Stabilizer (Cpd-7) | 0.05 |
| Solvent (Solv-9) | 0.40 |
| **Seventh Layer (protective layer)** | |
| Gelatin | 1.01 |
| Acryl-Modified Copolymer of Polyvinyl Alcohol (modification degree: 17%) | 0.04 |
| Liquid Paraffin | 0.02 |
| Surfactant (Cpd-11) | 0.01 |

(ExY) Yellow Coupler

A mixture of 1/1/1 (by mol ratio)

(ExY-1)

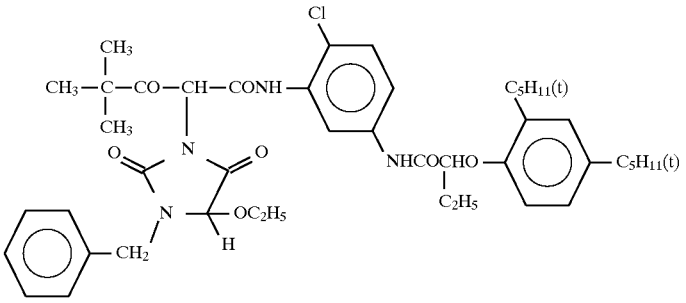

-continued
(ExY-2)
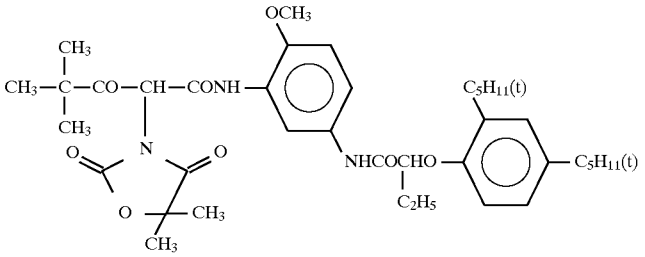
(ExY-3)
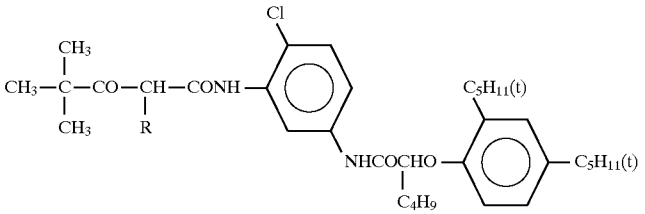
(ExM) Magenta Coupler
A mixture of 1/5 (by mol ratio)
(ExM-1)
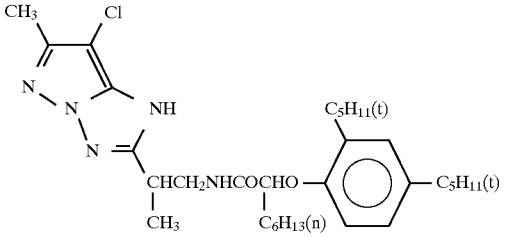
(ExM-2)
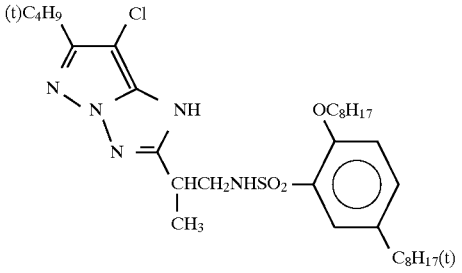
(ExC) Cyan Coupler
A mixture of 1/1 (by mol ratio)
(ExC-1)
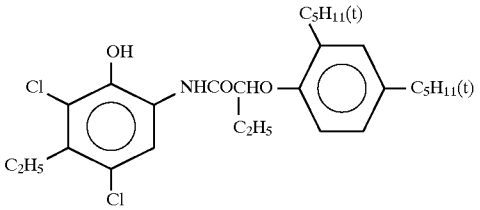

-continued
(ExC-2)
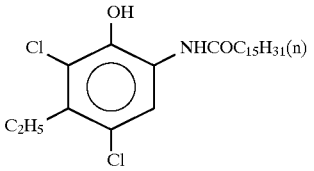
(Cpd-1) Dye Image Stabilizer
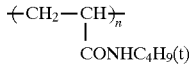
average molecular weight: 60,000
(Cpd-2) Dye Image Stabilizer
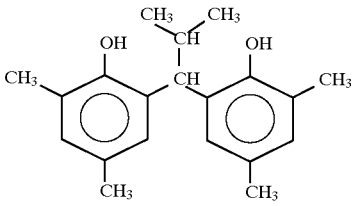
(Cpd-3) Dye Image Stabilizer
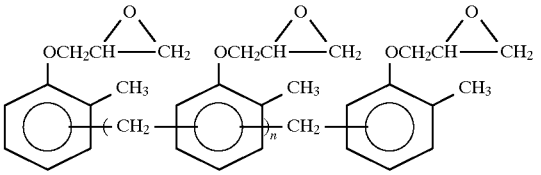
n = 7–8 (average value)
(Cpd-4) Color Mixing Preventive
A mixture of 1/1/1 (by weight ratio)
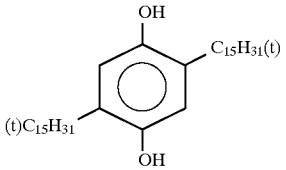
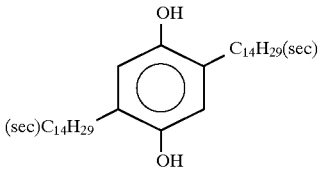
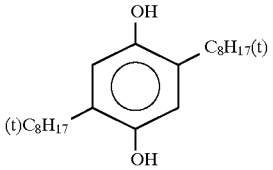

-continued
(Cpd-5) Dye Image Stabilizer
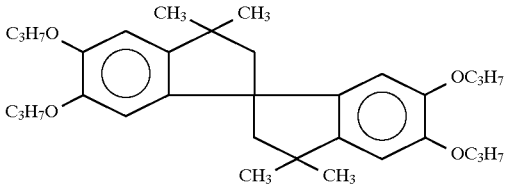
(Cpd-6) Dye Image Stabilizer
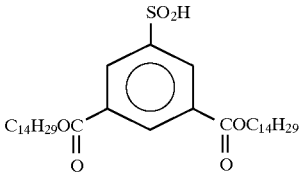
(Cpd-7) Dye Image Stabilizer
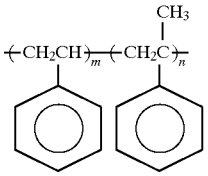
number average molecular weight: 600
m/n = 10/90
(Cpd-8) Dye Image Stabilizer
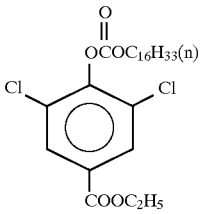
(Cpd-9) Dye Image Stabilizer
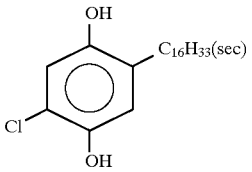
(Cpd-10) Dye Image Stabilizer
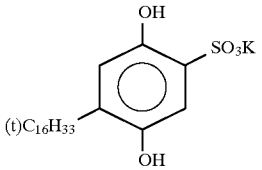

-continued
(Cpd-11) Surfactant
A mixture of 7/3 (by weight ratio)
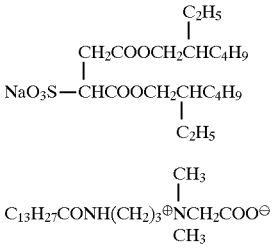
(Cpd-12) Preservative
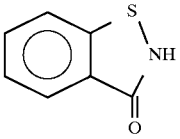
(Cpd-13) Preservative
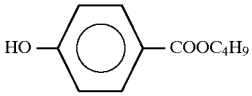
(Cpd-14) Preservative
1/1/1/1 mixture (by weight ratio) of a/b/c/d
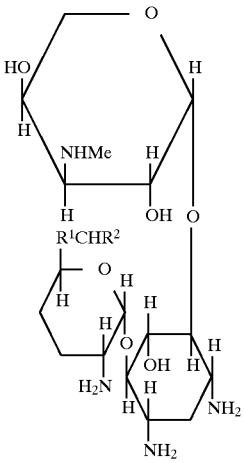
| | $R^1$ | $R^2$ |
|---|---|---|
| a | —Me | —NHMe |
| b | —Me | —$NH_2$ |
| c | —H | —$NH_2$ |
| d | —H | —NHMe |
(Cpd-15) Preservative
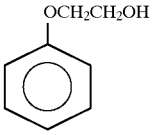

-continued
(Solv-1) Solvent
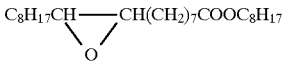
(Solv-2) Solvent
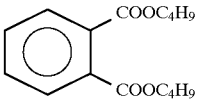
(Solv-3) Solvent
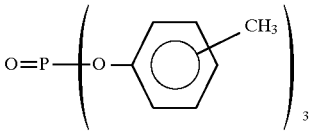
(Solv-4) Solvent
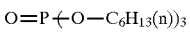
(Solv-5) Solvent
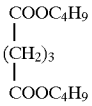
(Solv-6) Solvent
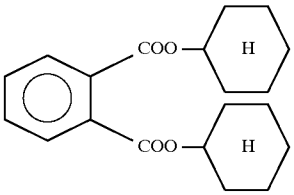
(Solv-7) Solvent
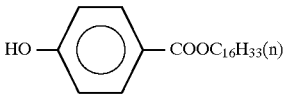
(Solv-8) Solvent
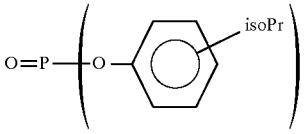
(Solv-9) Solvent
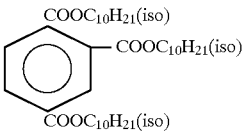

-continued
(UV-A) UV Absorber
A mixture of 4/3/2/1 (by weight ratio) of (1)/(2)/(3)/(4)
(1)
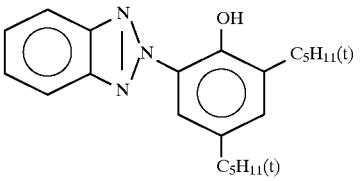
(2)
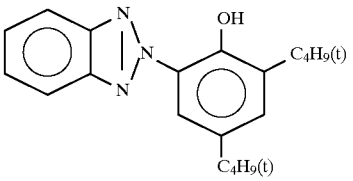
(3)
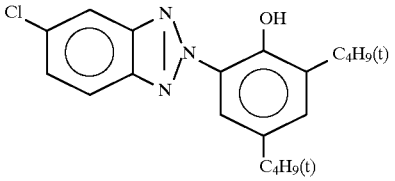
(4)
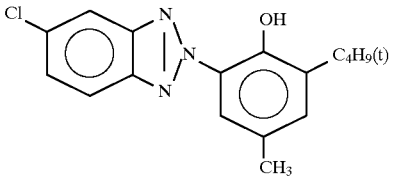
(UV-B) UV Absorber
A mixture of 5/2/2/2 (by weight ratio) of (1)/(2)/(3)/(4)
(1)
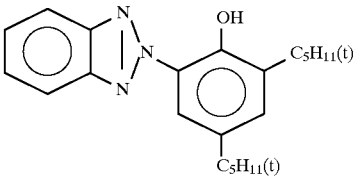
(2)
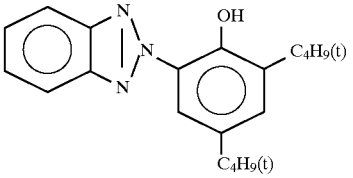

-continued
(3)
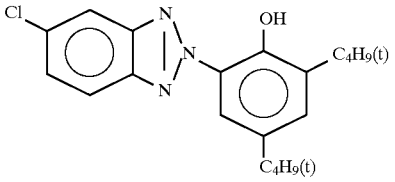
(4)
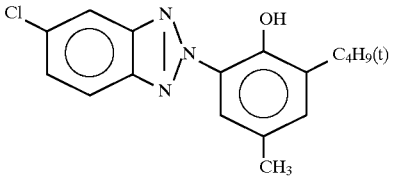
(UV-C) UV Absorber
A mixture of 6/2/2/2/3 (by weight ratio) of (1)/(2)/(3)/(4)/(5)
(1)
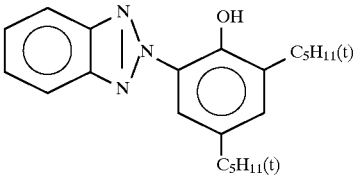
(2)
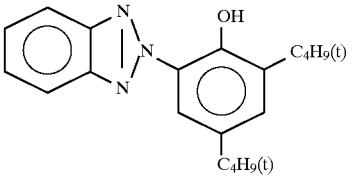
(3)
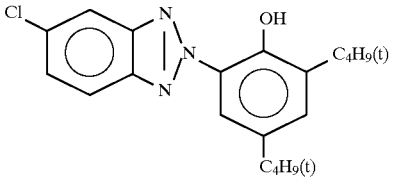
(4)
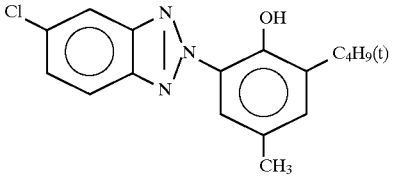

-continued (5)

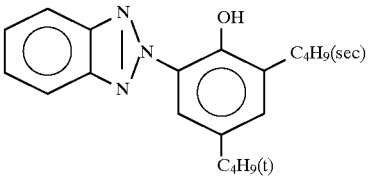

Photographic material Sample No. 501 was prepared in the same manner as the preparation of Sample No. 500 except that an interlayer containing 0.6 g/m$^2$ of gelatin was provided in place of the fourth layer (a color mixing preventive layer), and further, an undercoat layer having the same composition as the interlayer was provided beneath the first layer.

Further, photographic material Sample No. 502 was prepared in the same manner as the preparation of Sample No. 501 except that an interlayer shown below was provided in place of the fourth layer (an interlayer), and further, an undercoat layer having the composition shown below was provided beneath the first layer.

| Composition of Interlayer and Undercoat Layer | |
|---|---|
| Gelatin | 0.40 |
| Somasif ME100 | 0.20 |

The above Samples 500, 501 and 502 were subjected to three color separation exposure of BGR, then continuous processing was conducted according to the following processing step using a paper processor.

| Processing Step | Processing Temperature (°C.) | Processing Time (sec) | Replenishing Rate* (ml) | Tank Capacity (ml) |
|---|---|---|---|---|
| Color Development | 38.5 | 45 | 73 | 500 |
| Bleach-Fixing | 30–35 | 45 | 60 | 500 |
| Rinsing (1) | 30–35 | 20 | 500 | |
| Rinsing (2) | 30–35 | 20 | 500 | |
| Rinsing (3) | 30–35 | 20 | 370 | 500 |
| Drying | 70–80 | 60 | | |

*Replenishing rate per m$^2$ of the photographic material
Rinsing was conducted in a 3-tank countercurrent system from rinsing (1) to rinsing (3).

The composition of each processing solution was as follows.

| Color Developing Solution | Tank Solution | Replenisher |
|---|---|---|
| Water | 700 ml | 700 ml |
| Sodium Triisopropylene(β)-sulfonate | 0.1 g | 0.1 g |
| Ethylenediaminetetraacetic Acid | 3.0 g | 3.0 g |
| Disodium 1,2-dihydroxybenzene-4,6-disulfonate | 0.5 g | 0.5 g |
| Triethanolamine | 12.0 g | 12.0 g |
| Potassium Chloride | 6.5 g | — |
| Potassium Bromide | 0.03 g | — |
| Potassium Carbonate | 27.0 g | 27.0 g |
| Brightening Agent (WHITEX 4, manufactured by Sumitomo Chemical Co., Ltd.) | 1.0 g | 3.0 g |
| Sodium Sulfite | 0.1 g | 0.1 g |
| Disodium-N,N-bis(sulfonato-ethyl)hydroxylamine | 10.0 g | 13.0 g |
| N-Ethyl-N-(β-methanesulfon-amidoethyl)-3-methyl-4-aminoaniline Sulfate | 5.0 g | 11.5 g |
| Water to make | 1,000 ml | 1,000 ml |
| pH (25° C.) | 10.0 | 11.0 |

-continued

| Bleach-Fixing Solution (the tank solution and the replenisher are the same) | |
|---|---|
| Water | 600 ml |
| Ammonium Thiosulfate (700 g/liter) | 100 ml |
| Ammonium Sulfite | 40 g |
| Ammonium Ethylenediaminetetraacetato Ferrate | 55 g |
| Disodium Ethylenediaminetetraacetate | 5 g |
| Ammonium Bromide | 40 g |
| Nitric Acid (67%) | 30 g |
| Water to make | 1,000 ml |
| pH (25° C.) (adjusted with acetic acid and aqueous ammonia) | 4.8 |
| Rinsing Solution (the tank solution and the replenisher are the same) Ion Exchange Water (each concentration of calcium and magnesium is 3 ppm or less) | |

The parts to be colored cyan and magenta of Sample No. 501 were color mixed with magenta and cyan, respectively. On the contrary, color mixing did not occur at all in Sample No. 502 of the present invention, although a color mixing preventive was not contained.

Subsequently, Sample Nos. 500 to 502 after being processed were examined on their light fastness using a weatherometer with Xenon light of 200,000 lux. Color residual rate after irradiation at reflection density of 1.0 for 10 weeks was measured. The results obtained are shown in Table 14.

As is apparent from these results, comparative Sample Nos. 500 and 501 show extreme discoloration of magenta and yellow, while Sample No. 502 of the present invention is discolored little, therefore, the present invention can provide remarkable discoloration preventing effect. On the other hand, light fastness of a cyan layer, which is positioned uppermost of three colors, of three samples are almost the same degree. Cyan dyes formed by the above heat development are said to be discolored by photoreductive mechanism, and it is known that the light fastness is deteriorated by cutting off of oxygen on the contrary. However, as in the present invention, cutting off of oxygen from one layer can be conducted separately by sandwiching only the objective layer between the mica-containing layers. In virtue of this fact, the light fastness of a cyan image can be conspicuously improved without deteriorating the light fastness of magenta and yellow.

TABLE 14

| Light-Sensitive Element | Color Residual Rate (Xe 10 W) (unit: %) Yellow | Magenta | Cyan | Remarks |
|---|---|---|---|---|
| 500 | 23 | 13 | 48 | Comparison |
| 501 | 24 | 10 | 49 | Comparison |
| 502 | 78 | 70 | 53 | Invention |

EXAMPLE 6

Dye-fixing element Sample No. R600 and light-sensitive element Sample No. 600 were prepared in the same manner as the preparation of dye-fixing element Sample No. R300 and light-sensitive element Sample No. 301 in Example 3.

In the preparation of dye-fixing element Sample No. R600, 0.25 g/m$^2$ of water-soluble polymer (1) in the fourth layer (a protective layer) was changed to 0.125 g/m$^2$ of water-soluble polymer (1) and 0.125 g/m$^2$ of Somasif ME100 to prepare a dye-fixing element Sample No. R601.

Thus prepared light-sensitive element Sample No. 600 and dye-fixing element Sample Nos. R600 and R601 were processed using an imaging apparatus disclosed in JP-A-2-84634 and black image samples were prepared. These samples were preserved at 0° C. and 25° C. alternately every other day for one month and surface conditions were observed. With respect to dye-fixing element Sample No. R600, powdery deposits were observed on the surface, while with dye-fixing element Sample No. R601 of the present invention, such deposits were not detected at all.

EXAMPLE 7

Sample Nos. 701 to 703 were prepared in the same manner as Sample Nos. 401 to 403 of Example 4 except that the support used for the sample 104 of Example 1 of U.S. Pat. No. 5,597,682 (i.e., a PEN support having a underlayer and a backing layer and heat-treated by the process described from line 54, column 21 to line 29, column 23 of U.S. Pat. No. 5,597,682) was used in place of the cellulose triacetate film support. Photographic properties of these samples were evaluated in the same manner as Example 4, and similar results as Example 4 were obtained.

EXAMPLE 8

Sample No. 801 was prepared in the same manner as Sample No. 201 of Example 2 of JP-A-9-5912 (paragraph No. 0090 et seq.) except that the eighth layer (an interlayer) was changed as follows.

| | |
|---|---|
| Gelatin | 0.30 g |
| Somasif ME100 | 0.15 g |

Sample No. 801 thus prepared was stored under the conditions of 50° C., 80% RH for one week, then subjected to color reversal treatment described in paragraph 0080 et seq. of JP-A-9-5912, together with fresh photographic materials. As a result, neither fresh materials nor wet preserved materials generated color mixing.

EXAMPLE 9

Coated Sample A was prepared in the same manner as Coated Sample 4 of Example 1 of JP-A-9-80666 except that 0.9 g/m$^2$ of gelatin in the surface-protecting layer was changed to 0.5 g/m$^2$ of gelatin and 0.25 g/m$^2$ of Somasif ME100.

Coated Sample A thus prepared was stored under the conditions of 50° C., 80% RH for one week, then subjected to exposure and development as described in Example 1 of JP-A-9-80666, together with fresh Coated Sample A. As a result, the wet preserved material did not show decrease in sensitivity or the like due to the storage.

EXAMPLE 10

Sample B was prepared in the same manner as Sample 204 of Example 2 of Japanese Patent Application 8-46822 (corresponding to U.S. patent application Ser. No. 08/797,893) except that lime-treated gelatin in the protective layer and in the interlayer between the emulsion layers was changed to Somasif ME100 (the weight of each Somasif ME100: one-fifth the weight of each lime-treated gelatin).

Sample B thus prepared was stored under the conditions of 50° C., 80% RH for one week, then subjected to exposure and heat-development as described in Example 2 of Japanese Patent Application 8-46822, together with fresh Sample B. As a result, neither fresh materials nor wet preserved materials generated color mixing.

By the incorporation of a swellable inorganic stratifying compound into at least one layer (in particular, a protective layer or an interlayer) constituting a photographic element, various kinds of photographically useful compounds or gases in the atmosphere maleficent to photographic capabilities, such as oxygen, carbon dioxide, sulfur oxides, nitrogen oxides, can be prevented or inhibited from diffusing in or between layers. Superior effects thereof are enumerated below.

(1) When a swellable inorganic stratifying compound is used in the interlayer of coloring material layers, transfer between layers of coloring materials contained in the adjacent layers thereto during storage can be prevented, that is, an excellent effect in prevention of color mixing can be obtained.

(2) When a swellable inorganic stratifying compound is used in the interlayer of each emulsion layer of a color photographic material, color mixing due to diffusion of the oxidation product of a color developing agent to the adjacent layers can be prevented.

(3) Cutting off of oxygen only from the objective layer can be carried out independently by the layers containing a swellable inorganic stratifying compound. By sandwiching only the layer containing a compound liable to be (photo)oxidized between the layers containing the stratifying compound, storage stability of a photographic element can be improved without adversely affecting the compound which is deteriorated by the cutting off of oxygen (for example, conspicuous effect can be obtained in the improvement of light fastness of color paper).

(4) Deterioration of additives due to the diffusion of water (absorption of humidity) to the coated film of a photographic element can be controlled and storage stability under a high humidity condition can be improved.

(5) Powdering fault, which is a fault by deposits of the compound diffused from the coated film to the film surface, can be prevented.

(6) Problems such as coloration, discoloration or deterioration caused by a slight amount of nitrogen oxides or sulfur oxides in the atmosphere by diffusing in the film and reacting with the compound in a photographic element, can be prevented.

While the invention has been described in detail and with reference to specific examples thereof, it will be apparent to one skilled in the art that various changes and modifications can be made therein without departing from the spirit and scope thereof.

What is claimed is:

1. A silver halide photographic material comprising a support having thereon at least one light-sensitive silver halide emulsion layer, wherein at least one layer of said silver halide photographic material comprises a swellable inorganic stratifying compound with an aspect ratio of 100 or more.

2. A silver halide photographic material as claimed in claim 1, which further comprises at least one light-insensitive layer and wherein said swellable inorganic stratifying compound is present in at least one light-insensitive layer.

3. A photographic element which comprises a support having provided thereon a light-sensitive element comprising at least one light-sensitive silver halide emulsion layer and an image-receiving element receiving a silver image or a dye image formed in said light-sensitive element, wherein at least one layer of said photographic element comprises a swellable inorganic stratifying compound with an aspect ratio of 100 or more.

4. The photographic element as claimed in claim 3, wherein said swellable inorganic stratifying compound is present in at least one light-insensitive layer.

5. A photographic element which comprises a support having provided thereon a light-sensitive element comprising at least one light-sensitive silver halide emulsion layer and a processing element which is capable of being closely contacted with said light-sensitive element during development to have a function to supply components necessary for development to said light-sensitive element, a function to remove components which are unnecessary after development from said light-sensitive element or both of said functions, wherein at least one layer of said photographic element comprises a swellable inorganic stratifying compound with an aspect ratio of 100 or more.

6. The photographic element as claimed in claim 5, wherein said swellable inorganic stratifying compound is present in at least one light-insensitive layer.

7. The silver halide photographic material or photographic element as claimed in any of claims 1 to 6, wherein said swellable inorganic stratifying compound is present in an amount of from 5 to 5,000 $mg/m^2$.

8. The silver halide photographic material or photographic element as claimed in claim 7, wherein said swellable inorganic stratifying compound is present in an amount of from 50 to 500 $mg/m^2$.

9. The silver halide photographic material or photographic element as claimed in claim 8, wherein said swellable inorganic stratifying compound is present in an amount of from 100 to 300 $mg/m^2$.

10. The silver halide photographic material or photographic element as claimed in any of claims 1 to 6, wherein said swellable inorganic stratifying compound is swellable synthetic mica.

* * * * *